US011434917B1

(12) United States Patent
Bershader

(10) Patent No.: US 11,434,917 B1
(45) Date of Patent: Sep. 6, 2022

(54) METHODOLOGY AND ALGORITHMS FOR PROTECTING CENTRIFUGAL AND AXIAL COMPRESSORS FROM SURGE AND CHOKE

(71) Applicant: Roman Bershader, Marietta, GA (US)

(72) Inventor: Roman Bershader, Marietta, GA (US)

( * ) Notice: Subject to any disclaimer, the term of this patent is extended or adjusted under 35 U.S.C. 154(b) by 0 days.

(21) Appl. No.: 17/374,024

(22) Filed: Jul. 13, 2021

(51) Int. Cl.
*F04D 27/02* (2006.01)

(52) U.S. Cl.
CPC ..... *F04D 27/0246* (2013.01); *F04D 27/0223* (2013.01)

(58) Field of Classification Search
CPC ..... F04D 27/0223; F04D 27/0246
See application file for complete search history.

(56) References Cited

U.S. PATENT DOCUMENTS 10,047,759 B2 * 8/2018 Kundig ..... F25B 1/10

* cited by examiner

*Primary Examiner* — Richard A Edgar

(57) ABSTRACT

This disclosure describes a novel methodology for anti-surge and anti-choke control systems protecting centrifugal and axial compressors. The methodology, based on Buckingham's π-theorem for compressors, presents compressor performance maps in dimensionless rectangular π-term coordinates that are independent of compressor inlet conditions, fluid molecular weight and rotational speed. The full range of compressor operating points from surge to choke is monitored and controlled when surge and choke limits are available. This is accomplished by converting rectangular coordinates presented in π-terms to polar coordinates, and then converting them to a controlled variable used in the closed-loop controllers. The methodology provides control algorithms for variable speed compressors, variable geometry compressors equipped with inlet guide vanes or stator vanes that exhibit displacement of surge and choke limits. The methodology most accurately estimates the location of the operating point relative to its limit in polar coordinates if only the surge or choke limit is available. The presented protection methods are applicable to any known types of dynamic compressors for industrial, commercial, jet engines, turbochargers.

17 Claims, 10 Drawing Sheets

METHODOLOGY AND ALGORITHMS FOR PROTECTING CENTRIFUGAL AND AXIAL COMPRESSORS FROM SURGE AND CHOKE

TECHNICAL FIELD

The present invention generally relates to methods for protecting dynamic compressors from surge and choke using controlled variables obtained from converted compressor performance maps provided by compressor manufacturers or experimentally obtained during commissioning for use in control systems. More specifically, it relates to methods that most accurately estimates the operating point position relative to surge and choke limits by polar conversion to ensure most efficient compressor operation using conventional PID control.

BACKGROUND ART

There are two restrictions on the operation of centrifugal and axial compressors caused by different phenomena: at relatively low flow rates—surge; and at relatively high flow rates, a choke or a stone wall. These conditions must be taken into account in the design so that they can be prevented. Close-loop proportional-integral-derivative controllers are commonly used to regulate anti-surge valves to protect compressors from surge, and to regulate IGV inlet guide vanes or outlet valves to prevent compressor choking.

Both surge and choke are fluid mechanics phenomena that occur in compressors under certain circumstances. Then the theory of fluid mechanics is the basis for ensuring dynamically stable compressor operation. Fluid mechanics problems are too complex to be solved analytically, so their behavior must be verified experimentally. Since dynamically unstable compressor operation due to surge or rapid efficiency drops due to choking can occur at different rotational speeds, inlet pressures, inlet temperatures and different molecular weights of fluids (in industrial applications), the principle of similarity and dimensional analysis are used. The goal of similarity and dimensional analysis is to reduce the number and complexity of process parameters that affect a given physical phenomenon. In the case of compressors, the compressor performance can be displayed in dimensionless rectangular coordinates, chosen so that the process parameters at the compressor inlet, such as pressure, temperature and gas composition, are irrelevant. In other words, any particular operating point on the dimensionless compressor map defines the corresponding prototypes regardless of inlet conditions, gas composition, and even rotational speed. To find such dimensionless coordinates for compressors, the implicit functional relationship of all parameters involved in operation of the compressors can be analyzed in accordance with Buckingham's $\pi$-theorem. The first most common $\pi$-term characterizing the compressor performance is the Mach number of the incoming or outgoing flow, depending on the location of the flow meter, which is very often replaced by the term "corrected mass flow rate" used as the horizontal coordinate on compressor maps. The second most common the $\pi$-term is the ratio of the total outlet pressure to the total inlet pressure used as the vertical coordinate on the compressor maps.

Since the axial velocity of the continuous flow of fluid entering or leaving the compressor is involved in the Mach number calculations, the choice of flow meter is of great importance.

Microturbines, vortex meters, acoustic flow meters and other devices, that generate signals proportional to the axial velocity of the fluid, can be used in applications where the molecular weight of the fluid does not change. Differential pressure flow meters such as orifices, Venturi tubes, Venturi nozzles, annubars and etc. are required for applications where the molecular weight of the fluid changes and there is no molecular weight measurement.

There are various compressor protection algorithms for determining the position of the operating point in relation to the surge or choke line, represented in dimensionless rectangular coordinates. However, none of these rectangular coordinate methods can simultaneously determine the position of the operating point relative to the surge and choke lines in order to reproduce the full operating range, defined as the continuous value from the surge limit to the choke limit. Compressor performance curves in the plane are geometrically limited to perpendicularly oriented lines to reproduce such a range in rectangular coordinates. In addition, compressor operation can be described as moving the operating point towards surge or choke limits along the performance curves, or from curve to curve in the terms of a radius from some imaginary center point. Such movements are more like movements in polar coordinates than in rectangular ones. Therefore, polar coordinates seem to be the most appropriate choice in a context where the operating point in question is inherently tied to a direction and length from a center point on a plane. To demonstrate significant progress over existing compressor protection methods, the entire area between the surge and choke limiting lines must be converted from rectangular coordinates to polar coordinates. This invention describes the procedure for such a conversion.

A polar coordinate system in a plane consists of a fixed center point of the pole or zero point and rays emanating from that point. In the polar coordinate system selected in present invention, each point on a plane has a pair of polar coordinates: the radial coordinate r is the distance between the pole and the designated point, and $\varphi$ (or $\alpha$, or $\gamma$) is the angular coordinate, measured as the polar angle from the vertical axis to the radial coordinate r.

To convert a constant speed performance curve from a rectangular coordinate system to a polar coordinate system, it is necessary to make the assumption that each point on the performance curve in the new coordinate system is approximately the same distance from the center point. Or at least the radial coordinate of the surge point and the radial coordinate of the choke point, defined as the intersection points of the performance curve with the surge and choke lines, are the same.

However, a compressor control system using proportional-integral-derivative controllers requires further conversion of the two-dimensional representation into a numeric string of the one-dimensional controlled variable CV. In general, if the full operating point range from surge limit to choke limit is specified, then the controlled variable CV (%) in percent for the surge protection controller can be calculated relative to the surge limit from the equation below:

$$CV(\%) = 100\% \cdot \frac{CV - CV_{surge_limit}}{CV_{choke_limit} - CV_{surge_limit}} \tag{1}$$

For the controller protecting the compressor from choking, the controlled variable CV (%) in percent is calculated relative to the choke limit:

$$CV(\%) = 100\% \cdot \frac{CV_{choke_limit} - CV}{CV_{choke_limit} - CV_{surge_limit}} \tag{2}$$

The close-loop PID controller continuously calculates the error value ER as the difference between the desired setpoint SP (%) in percent and the input value of the controlled variable CV (%) in percent to tune the control output:

$$ER = SP\ (\%) - CV\ (\%) \tag{3}$$

For an anti-surge controller, the desired SP (surge protection margin) is usually 10% or less.

For an anti-choke controller, the desired SP (choke protection margin) is usually 5% or more.

In a case of the polar coordinate system, the controlled variable CV becomes the polar angle φ of the operating point with respect to its radial coordinate r. The controlled variable CV (%) for a surge protection controller is calculated relative to the surge limit at the constant radial coordinate r as the polar angle φ of the operating point minus the polar angle of the surge point $\varphi_{surge}$, divided by the full range, defined as subtracting the polar angle of the surge point $\varphi_{surge}$ from the polar angle of the choke point $\varphi_{choke}$:

$$CV(\%) = 100\% \cdot \left.\frac{\varphi - \varphi_{surge}}{\varphi_{choke} - \varphi_{surge}}\right|_r \tag{4}$$

The controlled variable CV (%) for a choke protection controller can be calculated relative to the choke limit for at the constant radial coordinate r as the polar angle of the choke point minus the polar angle of the operating point, divided by the full range, defined as subtracting the polar angle of the surge point from the polar angle of the choke point:

$$CV(\%) = 100\% \cdot \left.\frac{\varphi_{choke} - \varphi}{\varphi_{choke} - \varphi_{surge}}\right|_r \tag{5}$$

Variable geometry compressors equipped with the IGV inlet guide vanes or stator vanes in axial compressors may exhibit surge and choke lines shift in response to blades opening. Since this displacement is still expressed in π-term coordinates, an IGV correction function can be applied to the π-term coordinate of the Mach number as a function of the position of the input guide vanes before converting the rectangular coordinates to polar coordinates. The controlled variable CV (%) can then be calculated.

Most industrial compressors are selected to operate at or near maximum efficiency. For this reason, compressor maps often have surge lines and no choke lines, but instead have maximum flow endpoints on constant speed performance curves. Compressor testing to determine choke points during commissioning may be process limited. In such cases, where the full range of compressor operation, defined from surge limit to choke limit, is not available, only compressor surge protection is required. To this end, each surge point on the surge line assumes a constant polar angle. Assigning a constant polar angle to the surge points requires adjusting one of the two π-term coordinates, for instance, the Mach number becomes a function of the π-term coordinate of the pressure ratio, or vice versa, before converting the rectangular coordinates to polar coordinates. In the case of maximum flow endpoints, the controlled variable CV (%) for the surge protection controller can be calculated relative to the surge limit as the polar angle of the operating point minus the constant (as polar angle of the surge points), divided by the specified operating range, defined as subtracting the constant from the polar angle of the maximum flow endpoint.

The controlled variable CV (%), when only surge points collected during commissioning are available and no compressor performance maps are presented, can be calculated for the surge protection controller relative to the surge limit as the polar angle of the operating point minus a constant that defines the polar angle of the surge points divided by this constant.

It is important to note that selecting 10% as the desired setpoint when only surge limits are present will denote a safety margin relative to the surge limit and cannot be equal to the safety margin as a percentage of the compressor's full operating range.

The conversion methods described are applicable to any shape of compressor performance curves, from a slight slope of an almost horizontal line to relatively straight vertical lines.

SUMMARY OF THE INVENTION

The present invention proposes novel algorithms for practical use in control systems that protect dynamic compressors from surging and choking.

The rectangular to polar conversion reproduces the entire range of operating points with the most accurate positioning of the operating points relative to surge and choke limits, effectively protecting the compressors from both surge and choke.

The invention provides the most realistic representation of the compressor operation in a wide range, regardless of changes in input conditions, molecular weight, rotation speed, position of the guide vanes.

The new surge and choke protection algorithms presented in the invention, when only surge points or only choke points are present, are the most understood in compressor control practice.

The invention proposes new algorithms for calculating controlled variables CV (%) that are nearly linear, which makes the tuning of the PID controllers very precise.

DESCRIPTION OF INVENTION

Figure 1:
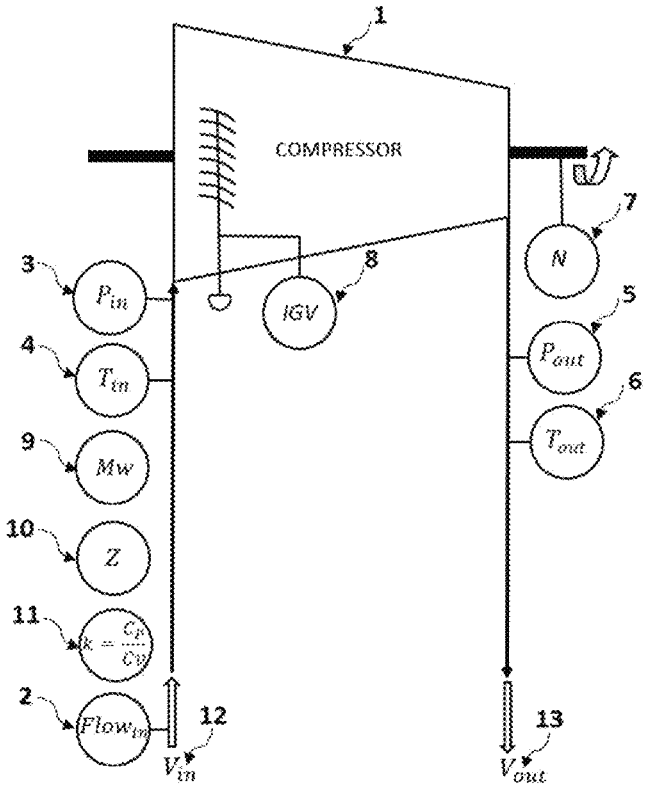
FIG. 1 schematically shows the input and outlet signals; gas properties at the compressor inlet.

FIG. 1 shows a schematic diagram of dynamic compressor 1 and most common input signals: measured flow rate 2, static inlet pressure 3, static inlet temperature 4, static output pressure 5, static output temperature 6, rotational speed 7, position of the inlet guide vanes or stator vanes 8; fluid properties 9,10,11; calculated axial fluid velocities 12,13 used in control algorithms.

There are a number of dimensionless groups (π-terms) that can be obtained from Buckingham's π-theorem applied to compressors, but the most commonly chosen π-terms are Mach number $\Pi_1$, and compressor total pressure ratio $\Pi_2$. Both of these π-terms are used in present invention.

The performance of dynamic compressors may be described by following quantities:

| | |
|---|---|
| m | Fluid mass flow |
| N | Rotor rotational speed usually measured as revolution per minute (RPM) |
| V | Axial fluid velocity at the compressor inlet or outlet depending on the location of the flow meter |
| a | The speed of sound at the inlet or outlet of the compressor |
| Mw | Fluid molecular weight |
| k | Specific heat ratio |
| Z | Fluid compressibility factor |
| $R_0$ | Universal gas constant |
| ρ | Density of fluid at the compressor inlet (or outlet) |
| D | Linear dimension of a compressor or piping characteristic |
| $P_{t_in}$ | Total or stagnation pressure at compressor inlet |
| $T_{t_in}$ | Total or stagnation temperature at compressor inlet |
| $P_{t_out}$ | Total or stagnation pressure at compressor outlet |
| $T_{t_out}$ | Total or stagnation temperature at compressor outlet |

Where:

$$V = \frac{4 \cdot m}{\rho \cdot \pi \cdot D^2} \tag{6}$$

$V=V_{in}$ and $\rho=\rho_{in}$ if the flow meter located at the inlet, $V=V_{out}$ and $\rho=\rho_{out}$ if the flow meter located at the outlet; π is a mathematical constant of approximately 3.14; D is the diameter of the cross-section area at compressor inlet ($D_{in}^2$) or outlet ($D_{out}^2$).

For compressor inlet:

$$\rho_{in} = \frac{Mw \cdot P_{t_in}}{Z_{in} \cdot R_0 \cdot T_{t_in}} \tag{7}$$

$$a_{in} = \sqrt{\frac{k_{in} \cdot R_0 \cdot T_{t_in}}{Mw}} \tag{8}$$

$$k_{in} = \frac{Cp}{Cv} \tag{9}$$

Mach number at compressor inlet:

$$\prod_{1_in} = \frac{V_{in}}{a_{in}} \tag{10}$$

Mach number at compressor outlet:

$$\prod_{1_out} = \frac{V_{out}}{a_{out}} \tag{11}$$

Compressor pressure ratio (total to total):

$$\prod_{2} = \frac{P_{t_out}}{P_{t_in}} \tag{12}$$

And then:

$$T_{t_in} = T_{in} \cdot \left(1 + \frac{k-1}{2} \cdot \prod_{1_in}^{2}\right) \tag{13}$$

where $T_{in}$—static temperature at the compressor inlet in absolute units.

$$T_{t_out} = T_{out} \cdot \left(1 + \frac{k-1}{2} \cdot \prod_{1_out}^{2}\right) \tag{14}$$

where $T_{out}$—static temperature at the compressor outlet in absolute units.

For incompressible flow:

$$P_{t_in} = P_{in} \cdot \left(1 + \frac{k}{2} \cdot \prod_{1_in}^{2}\right) \tag{15}$$

where $P_{in}$—static pressure at the compressor inlet in absolute units, $\Pi_{1_in}$—Mach number at compressor inlet ≤0.3.

$$P_{t_out} = P_{out} \cdot \left(1 + \frac{k}{2} \cdot \prod_{1_out}^{2}\right) \tag{16}$$

where $\rho_{out}$—static pressure at the compressor outlet in absolute units, $\Pi_{1_out}$—Mach number at compressor outlet ≤0.3.

Whenever the Mach number in the stream exceeds about 0.3, the stream becomes compressible and the density of the fluid can no longer be considered as constant.

For compressible flow:

$$P_{t_in} = P_{in} \cdot \left(1 + \frac{k-1}{2} \cdot \prod_{1_in}^{2}\right)^{\frac{k}{k-1}} \tag{17}$$

where $P_{in}$—static pressure at the compressor inlet in absolute units, $\Pi_{1_in}$—Mach number at compressor inlet >0.3.

$$P_{t_out} = P_{out} \cdot \left(1 + \frac{k-1}{2} \cdot \prod_{1_out}^{2}\right)^{\frac{k}{k-1}} \tag{18}$$

where $P_{out}$—static pressure at the compressor outlet in absolute units, $\Pi_{1_in}$—Mach number at compressor outlet >0.3.

The relationship between the Mach numbers at the inlet and outlet of the compressor, given that $Z_{in} \cong Z_{out}$ and $k_{in} \cong k_{out}$, follows from the equation:

$$\prod_{1_in} = \frac{D_{out}^2}{D_{in}^2} \cdot \prod_{1_out} \cdot \left(\prod_{2}\right)^{\left(1-\frac{n-1}{2n}\right)} \tag{19}$$

Where n is the polytropic exponent, which can be calculated using the equation:

$$n = \left(1 - \frac{\left(\frac{T_{t_out}}{T_{t_in}}\right)}{\left(\frac{P_{t_out}}{P_{t_in}}\right)}\right)^{(-1)} \tag{20}$$

With a moderate change in friction in the system, n changes insignificantly and can be taken in calculations as a constant.

In applications where differential pressure meters are used the inlet Mach number $\Pi_{1_in}$ can be calculated from the equation:

$$\Pi_{1_in} = \frac{4 \cdot Const}{\pi \cdot D_{in}^2 \cdot \sqrt{k_{in}}} \cdot \sqrt{\frac{\Delta P_{in}}{P_{in}}} \tag{21}$$

where $\Delta P_{in}$—is the pressure drop across of the flow meter at the inlet to the compressor, $P_{in}$ is the static pressure at the compressor inlet in absolute units, Const is the flow meter constant, $\pi$ is a mathematical constant of approximately 3.14, $D_{in}$—internal diameter of the inlet pipe.

Figure 2:
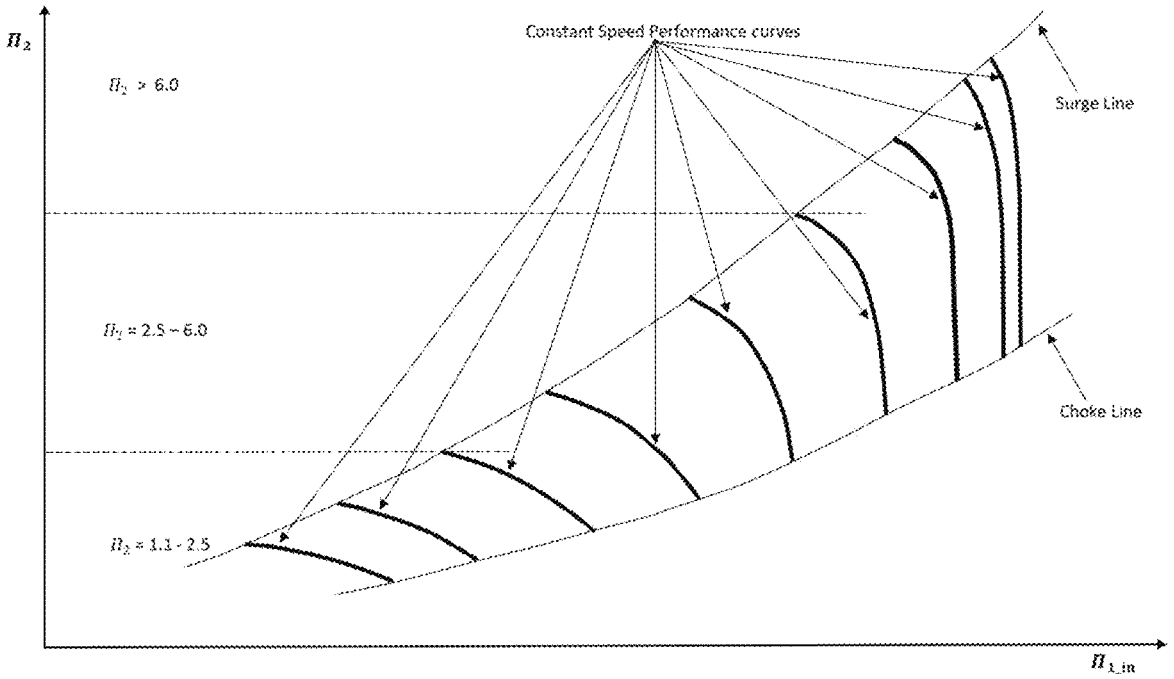
FIG. 2 shows the different shapes of the compressor performance curves.
Figure 3:
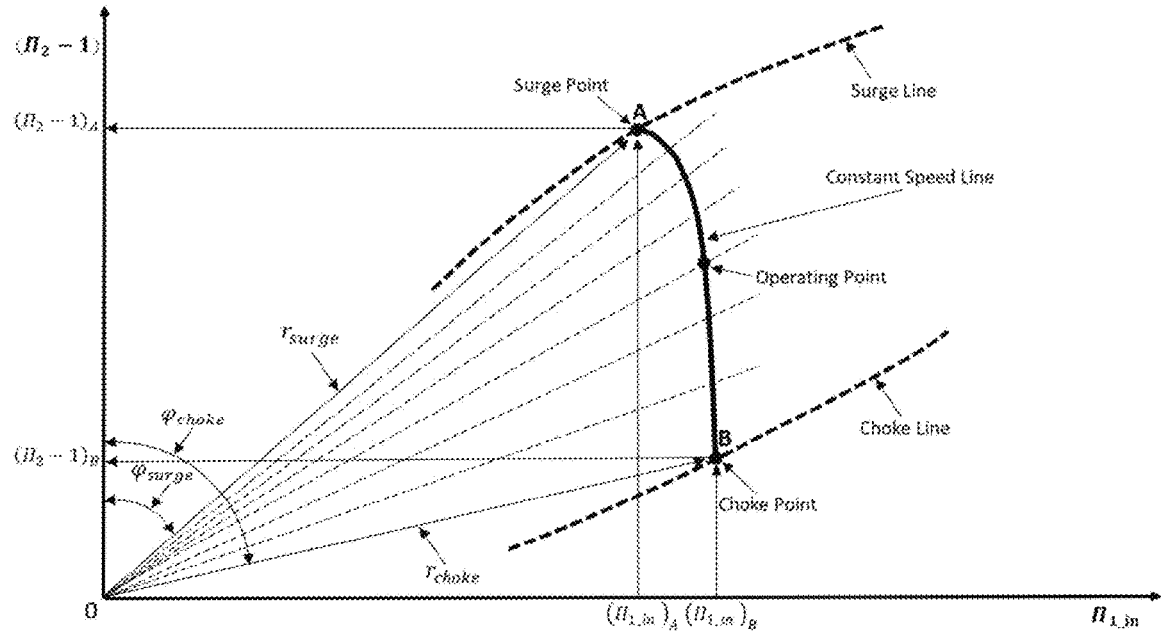
FIG. 3 depicts the operating point in the π-term coordinates between the surge and choke limits on a constant speed line, with rays emanating from the pole indicating possible movements.

Typical performance curves of dynamic variable speed compressors without guide vanes are shown in FIG. 2 in $\pi$-terms, with shape of the curves varying from slope to horizon for compressors with a nominal compression ratio of about 1.1 to 2.5, intermediate curves for compressors with a nominal compression ratio of 2.5 to 6.0, and relatively straight vertical lines, for compressors with compression ratio higher than 6.0. It should be noted that compressors equipped with guide vanes can have relatively vertical lines at a compression ratio of about 1.1 to 2.5 with the blades closed. FIG. 3 displays a constant speed performance curve in the $\pi$-term coordinates: $\Pi_{1_in}$ is the Mach number at compressor inlet, and $(\Pi_2-1)$ is the compressor pressure ratio (total to total) minus one; operating point between surge point A and choke point B; rays emanating from the zero point, indicating possible movements of the operating point; $r_{surge}$ is the radial coordinate and $\varphi_{surge}$ is the angular coordinate of the surge point; $r_{choke}$ is the radial coordinate and $\varphi_{choke}$ is the angular coordinate of the choke point. The technique of converting the constant speed performance curve from rectangular coordinates to polar coordinates is based on the assumption that the distance from the zero point to the surge point A and the distance from zero point to the choke point B are equal. To equalize two unequal radial coordinates, a polar conversion factor P is entered. The distance from the zero point to the surge point A can then be calculated using the polar conversion factor:

$$r_{surge} = \sqrt{(\Pi_2 - 1)_A^2 + (P \cdot \Pi_{1_in})_A^2} \tag{22}$$

where $(\Pi_2-1)_A$ and $(\Pi_{1_in})_A$—coordinates of the surge point A.

The distance from the zero point to the choke point B can also be calculated using the polar conversion factor:

$$r_{choke} = \sqrt{(\Pi_2 - 1)_B^2 + (P \cdot \Pi_{1_in})_B^2} \tag{23}$$

where $(\Pi_2-1)_B$ and $(\Pi_{1_in})_B$—coordinates of the choke point B.

From the two equations (22) and (23), assuming $r_{surge}=r_{choke}$, the polar conversion factor P for the AB constant speed performance curve can be calculated as:

$$P = \sqrt{\frac{(\Pi_2 - 1)_A^2 - (\Pi_2 - 1)_B^2}{(\Pi_{1_in})_B^2 - (\Pi_{1_in})_A^2}} \tag{24}$$

Figure 4:
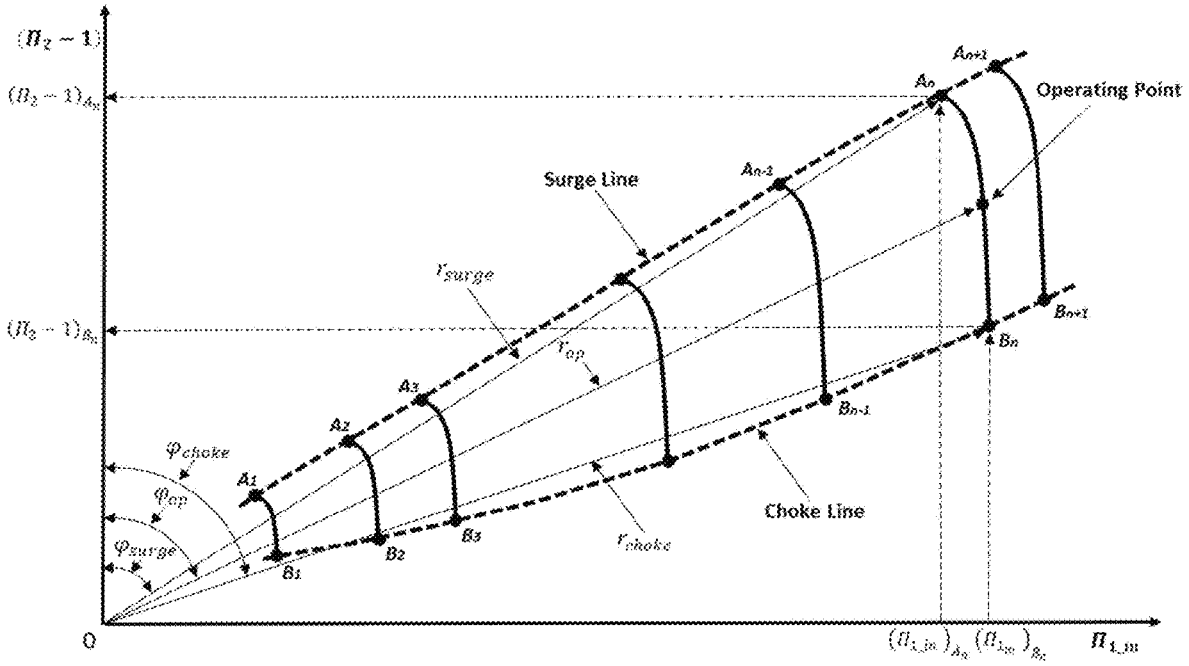
FIG. 4 shows a set of hypothetical constant speed performance curves with operating point, surge and choke limits.

FIG. 4 shows a set of hypothetical constant speed performance curves with points $A_1$, $A_2$, $A_3$ . . . $A_{n-1}$, $A_n$ and $A_{n+1}$ as surge points; and points $B_1$, $B_2$, $B_3$ . . . $B_{n-1}$, $B_n$ and $B_{n+1}$ as choke points. Performance curves may differ from each another, but curves formed by the same compressor, operating in a moderately narrow range with little change in system friction, should be correlated in shape. For this reason, the polar conversion factor P shouldn't change much. However, the polar conversion factor must be calculated for each given curve shown in FIG. 4. Then the arithmetic means or average of polar conversion factors, the sum of the polar conversion factors divided by total number of curves in the set (n+1), must be used to convert a rectangular coordinate system in a polar coordinate system.

$$P_{mean_aveage} = \frac{P_1 + P_2 + P_3 + \ldots + P_{n-1} + P_n + P_{n+1}}{n+1} \tag{25}$$

Figure 5:
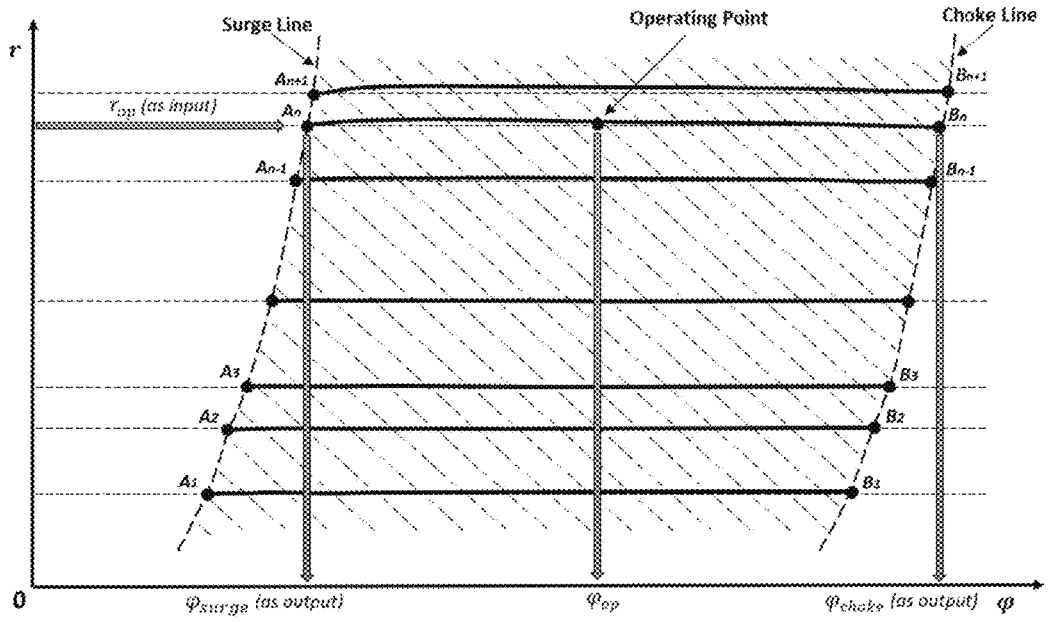
FIG. 5 depicts the effect of transformation by plotting polar coordinates r and φ on the rectangular coordinates.

In an imaginary two-dimension polar coordinate system on the plane, each point corresponds to a pair of polar coordinates (r, $\varphi$). The operating point, located on the constant speed curve $A_nB_n$ as shown in FIG. 4, has a radial coordinate $r_{op}$ and an angular coordinate $\varphi_{op}$, which is measured from the vertical axis $(\Pi_2-1)$. An example of the polar conversion of the constant speed performance curves and positioning of the operating point on the $A_nB_n$ curve of FIG. 4 is shown in FIG. 5, where the new modified constant speed curves and the operating point on the line $A_nB_n$ are shown in the polar coordinates plotted on the rectangular coordinates with the vertical axis as the radial coordinate r, and the horizontal axis as the angular coordinate $\varphi$. The polar coordinates plotted on the rectangular coordinates, as shown in FIG. 5, illustrate the transformation effect, where the compressor performance curves are straightened and can now be approximated by horizontal lines, and the shaded area surrounded by the surge and choke limiting lines defines the dynamically stable area of the compressor operation.

The equations for calculating of a pair of polar coordinates (r, φ) for each point are shown below:

$$r = \sqrt{(\Pi_2 - 1)^2 + (P_{mean_aveage} \cdot \Pi_{1_in})^2} \tag{26}$$

$$\varphi = \text{ARCTAN}\left(\frac{P_{mean_aveage} \cdot \Pi_{1_in}}{(\Pi_2 - 1)}\right) \tag{27}$$

Where ARCTAN is the inverse mathematical function of the tangent function used to obtain an angle from any of the trigonometric angular relations.

The functions shown below in tabular form in TABLE 1 with sorted rows and columns of characteristic data represent the polar angles of the surge and choke points as functions of the radial coordinate r as an argument.

TABLE 1

| | | Radial coordinate | Polar angle of surge point | Polar angle of choke point |
|---|---|---|---|---|
| INPUT ($r_{op}$) → | 1 | $(r)_1$ | $(\varphi_{surge})_1$ | $(\varphi_{choke})_1$ |
| | 2 | $(r)_2$ | $(\varphi_{surge})_2$ | $(\varphi_{choke})_2$ |
| | 3 | $(r)_3$ | $(\varphi_{surge})_3$ | $(\varphi_{choke})_3$ |
| | n − 1 | $(r)_{n-1}$ | $(\varphi_{surge})_{n-1}$ | $(\varphi_{choke})_{n-1}$ |
| | n | $(r)_n$ | $(\varphi_{surge})_n$ | $(\varphi_{choke})_n$ |
| | n + 1 | $(r)_{n+1}$ | $(\varphi_{surge})_{n+1}$ ↓ | $(\varphi_{choke})_{n+1}$ ↓ |
| | | | OUT1 ($\varphi_{surge}$) | OUT2 ($\varphi_{choke}$) |

The definition of the functions is taken from FIG. 5 when the shaded area is crossed by the horizontal lines r at the indicated surge and choke points used to populate TABLE 1.

It should be noted that all points other than those inserted in the rows and columns can be considered interpolated values. Linear interpolation is applied to a specific value between the two values listed in the table, which can be achieved by geometric reconstruction of a straight line between two adjacent points in the table.

The use of table functions is that the input to the table is the radial coordinate of the operating point $r_{op}$ calculated from to the equation (26), and the outputs are the angular coordinates $\varphi_{surge}$ and $\varphi_{choke}$ of the surge and choke points. The graphical definition of the functions is shown in FIG. 5 where the shaded area crossed by the horizontal line $r_{op}$ and the angular coordinates $\varphi_{surge}$ and $\varphi_{choke}$ are the projections of the surge and choke points onto the horizontal axis φ with the operating point $\varphi_{op}$ between them as the calculated value according to the equation (27).

Therefore, the controlled variable CV (%) in percent for surge protection is calculated as:

$$CV\ (\%) = 100\% \cdot \left.\frac{\varphi_{op} - \varphi_{surge}}{\varphi_{choke} - \varphi_{surge}}\right|_{r_{op}} \tag{28}$$

and for chock protection:

$$CV\ (\%) = 100\% \cdot \left.\frac{\varphi_{choke} - \varphi_{op}}{\varphi_{choke} - \varphi_{surge}}\right|_{r_{op}} \tag{29}$$

The shape of the constant speed performance curves can change from compressor to compressor or as the compressor operating range expands. However, the conversion method represented by equations (26) and (27) is applicable to any shape of performance curve. The compressor performance curves shown in FIG. 2, which have significant shape variations, will still be straightened when plotted in rectangular coordinates r versus φ, and the appearance of the modified constant speed performance curves can be approximated by horizontal lines.

Figure 6:
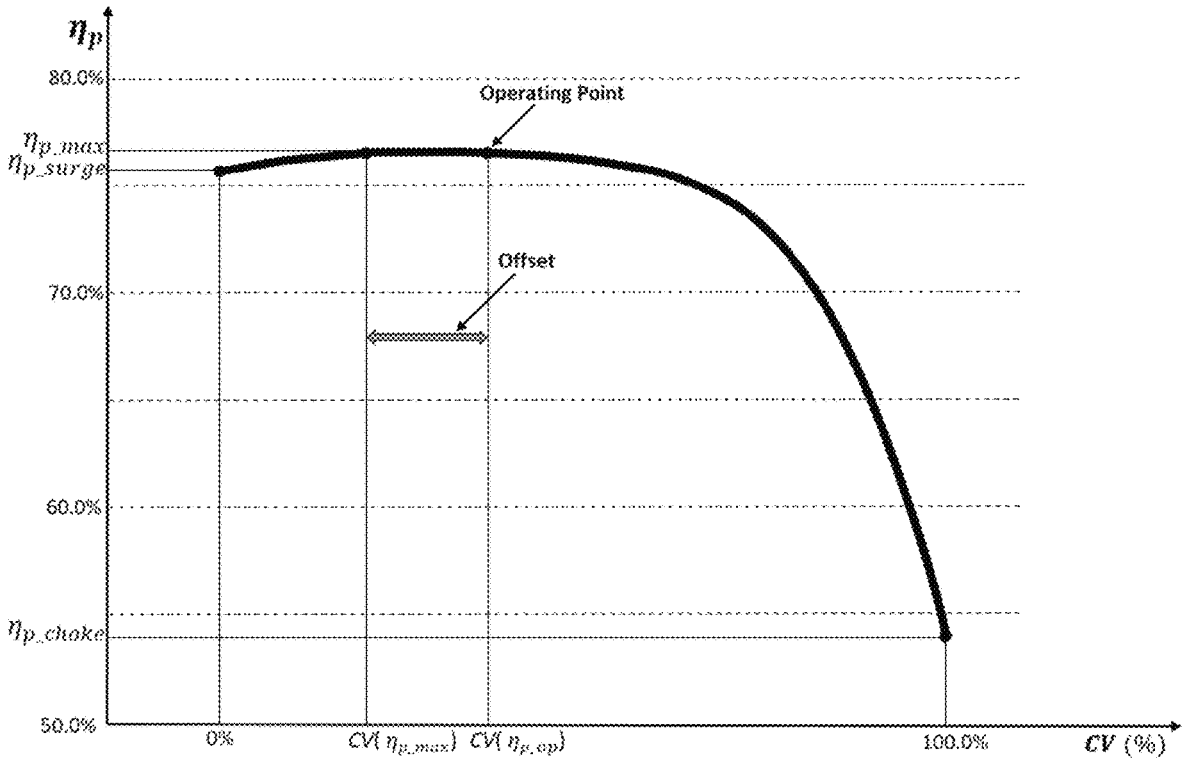
FIG. 6 represents the correlation between the controlled variable CV (%) and the polytropic efficiency of the compressor.

The generalized correlation between the controlled variable CV (%) in percent and the polytropic efficiency of the compressor $\eta_p$ in percent covering entire operating range from surge to choke limits, is shown in FIG. 6. The offset between CV($\eta_{p_max}$)—the compressor's maximum polytropic efficiency point and CV($\eta_{p_op}$) of the operating point can be used in PID controllers as a controlled variable to balance the load between the compressors operating in parallel or in series.

Figure 7:
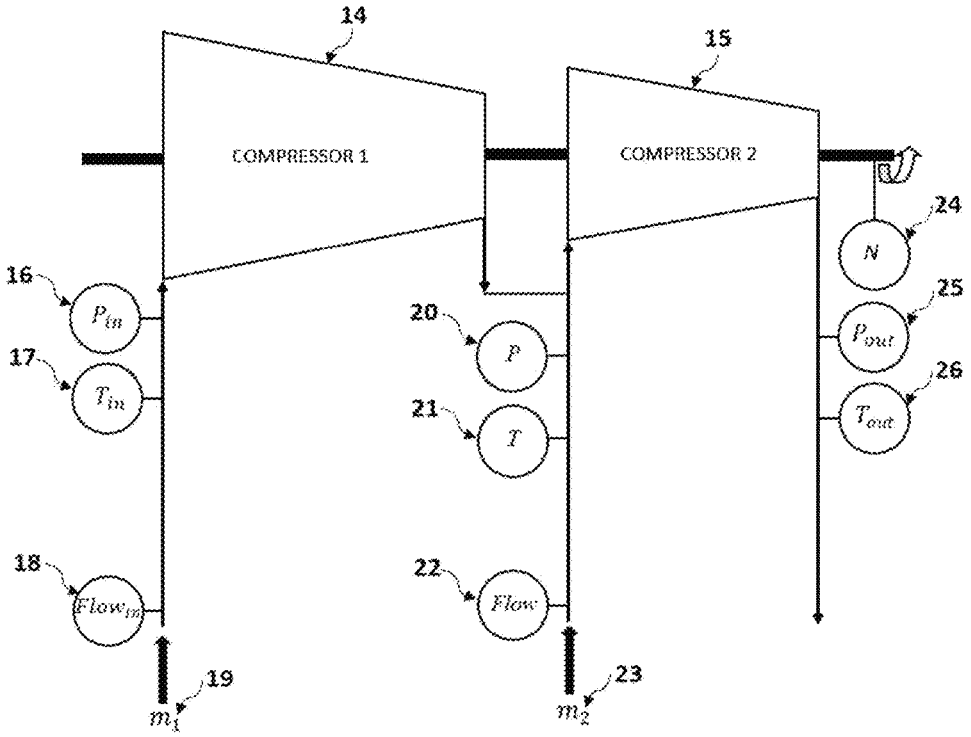
FIG. 7 schematically shows two dynamic compressors 14 and 15 in series.

FIG. 7 shows a schematic diagram of two dynamic compressors 14 and 15 installed in series, the second compressor 15 having a side stream inlet flow. The input signals shown in FIG. 7: rotational speed 24, static pressure at the inlet of the first compressor 16, static temperature at the inlet of the first compressor 17, measured flow rate at the inlet of the first compressor 18, calculated mass flow rate of the first compressor 19, static inlet pressure of the second compressor 20, static inlet temperature of the second compressor 21, measured side stream flow rate entering the second compressor 22, calculated mass flow of the side stream entering the second compressor 23, static output pressure 25, static output temperature 26.

The total mass flow $m_{total}$ through the second compressor 15 is then calculated as the sum of the mass flow $m_1$ through the first compressor 14 plus the side stream mass flow $m_2$ entering between compressors:

$$m_{total} = m_1 + m_2 \tag{30}$$

To protect the second compressor, the Mach number $(\Pi_{1_in})_{2_total}$ for the second stage must be used, which is calculated from the total mass flow $m_{total}$, assuming that this mass flow passes through the inlet of the second compressor. For differential pressure meters, taking into account that compressibility factors and specific heat ratios of the first and second compressors are equal $Z_1 \cong Z_2$ and $k_1 \cong k_2$ the Mach number $(\Pi_{1_in})_{2_total}$ can be calculated as:

$$(\Pi_{1_in})_{2_total} = \frac{D_1^2}{D_2^2} \cdot (\Pi_2)_1^{\left(\frac{n-1}{2n} - 1\right)} \cdot (\Pi_{1_in}) + (\Pi_{1_in})_2 \tag{31}$$

Where $D_1$ is the diameter of the cross-section area at the inlet of the first compressor; $D_2$—cross-section diameter at the inlet of the second compressor; $(\Pi_2)_1$—pressure ratio across the first compressor, calculated according to equation (12); n is the polytropic exponent of the first compressor, it can be taken as a constant or calculated by equation (20); $(\Pi_{1_in})_1$—Mach number at the inlet of the first compressor and $(\Pi_{1_in})_2$—Mach number of the side stream of the second compressor, both calculated according to equation (21).

Figure 8:
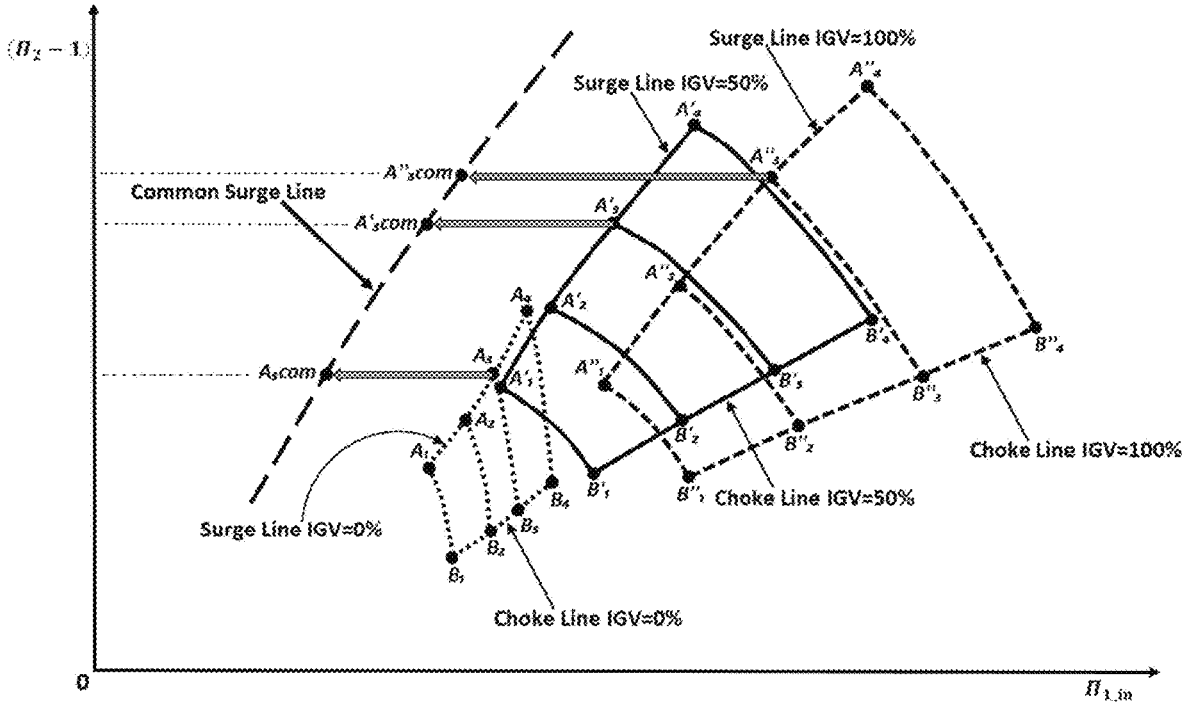
FIG. 8 shows three sets of four hypothetical constant speed performance curves for three different IGV positions.

In many cases, variable geometry compressors with the IGV inlet guide vanes or stator vanes in axial compressors are used. Compressors of this type can have performance drift depending on the blades opening. The effect of IGV opening on the compressor performance is shown in FIG. 8 for three hypothetical sets of constant speed performance curves representing three arbitrary selected IGV opening positions 0%, 50% and 100% in coordinates $\Pi_{1_in}$ relative to $(\Pi_2 - 1)$. Each set consists of four curves for demonstrative purposes. Lines $A_1B_1$, $A_2B_2$, $A_3B_3$ and $A_4B_4$ represent constant speed performance curves at 0% IGV position;

lines $A'_1B'_1$, $A_2'B'_2$, $A'_3B'_3$ and $A'_4B'_4$ represent constant speed performance curves at 50% IGV position; and lines $A''_1B''_1$, $A''_2B''_2$, $A''_3B''_3$ and $A''_4B''_4$ represent constant speed performance curves at 100% IGV position.

FIG. 8 graphically illustrates a technique for adapting three separate surge limiting lines of three different IGV positions into one common surge line. Points $A_3$, $A'_3$ and $A''_3$ in the FIG. 8 refer to the same compressor speed selected as the assumed design operating speed. The points are chosen as an example to obtain the function f(IGV) of the inlet guide vanes to modify the π-term coordinate of the Mach number. The shift of the surge points $A_3$, $A'_3$ and $A''_3$ to the left while keeping their $(\Pi_2-1)$ coordinates unchanged, denotes the new positions of the surge points $A_3$com, $A'_3$com and $A''_3$com, which form one common surge line.

Dividing the coordinates of the surge points $A_3$com, $A'_3$com and $A''_3$com into the values of the coordinates of the surge points $A_3$, $A'_3$ and $A''_3$, respectively, reveals the method for constructing the IGV function:

$$f(IGV) = \frac{(\Pi_{1_in})_{A_com}}{(\Pi_{1_in})_A} \tag{32}$$

Figure 9:
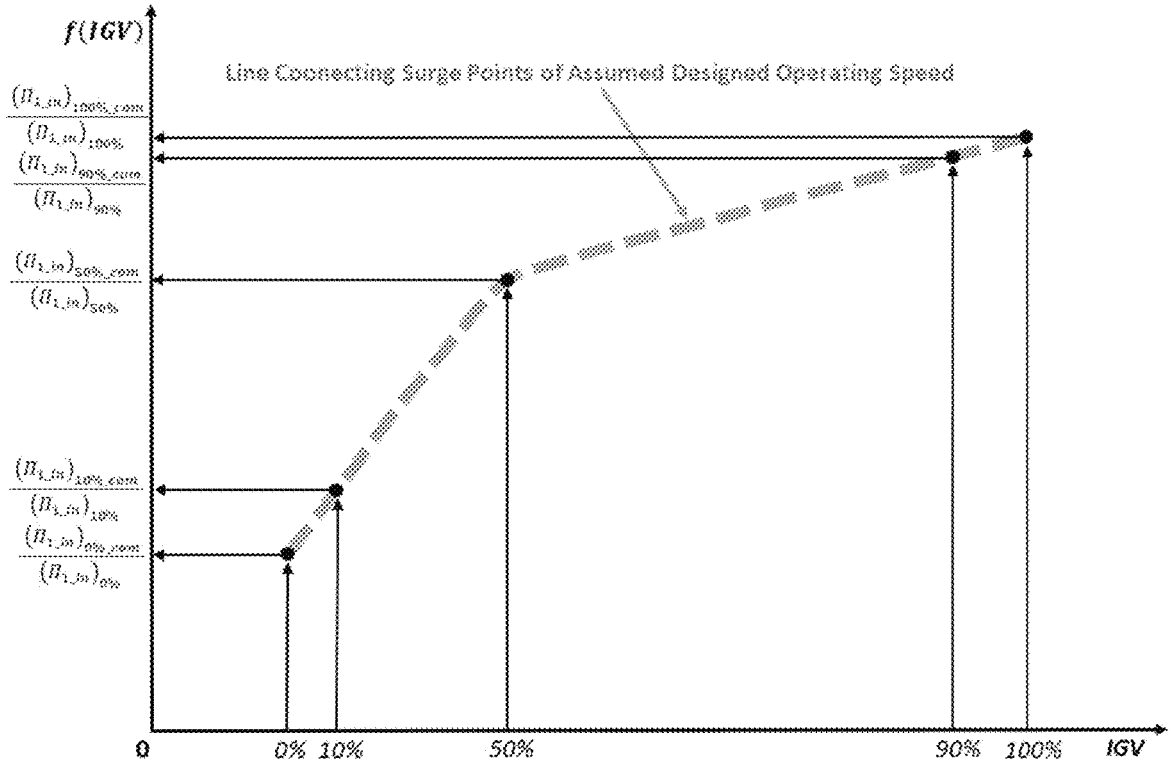
FIG. 9 describes the IGV function.

FIG. 9 shows the position of the inlet guide vanes IGV as a percentage relative to the IGV function and depicts the technique for calculating the IGV function. The function shown below in tabular form in TABLE 2 with two columns of characteristic data for an IGV position as the argument from 0% to 100% and the function f(IGV) of all available surge points of design operating speed to plot the expected common surge line.

TABLE 2

| | | IGV position % | function f(IGV) |
|---|---|---|---|
| | 1 | 0% | $\frac{(\prod_{1_in})_{0\%_com}}{(\prod_{1_in})_{0\%}}$ |
| INPUT (IGV) → | 2 | 10% | $\frac{(\prod_{1_in})_{10\%_com}}{(\prod_{1_in})_{10\%}}$ |
| | | 50% | $\frac{(\prod_{1_in})_{50\%_com}}{(\prod_{1_in})_{50\%}}$ |
| | i-1 | 90% | $\frac{(\prod_{1_in})_{90\%_com}}{(\prod_{1_in})_{90\%}}$ |
| | i | 100% | $\frac{(\prod_{1_in})_{100\%_com}}{(\prod_{1_in})_{100\%}}$ |
| | | | ↓ OUTPUT (f(IGV)) |

Figure 10:
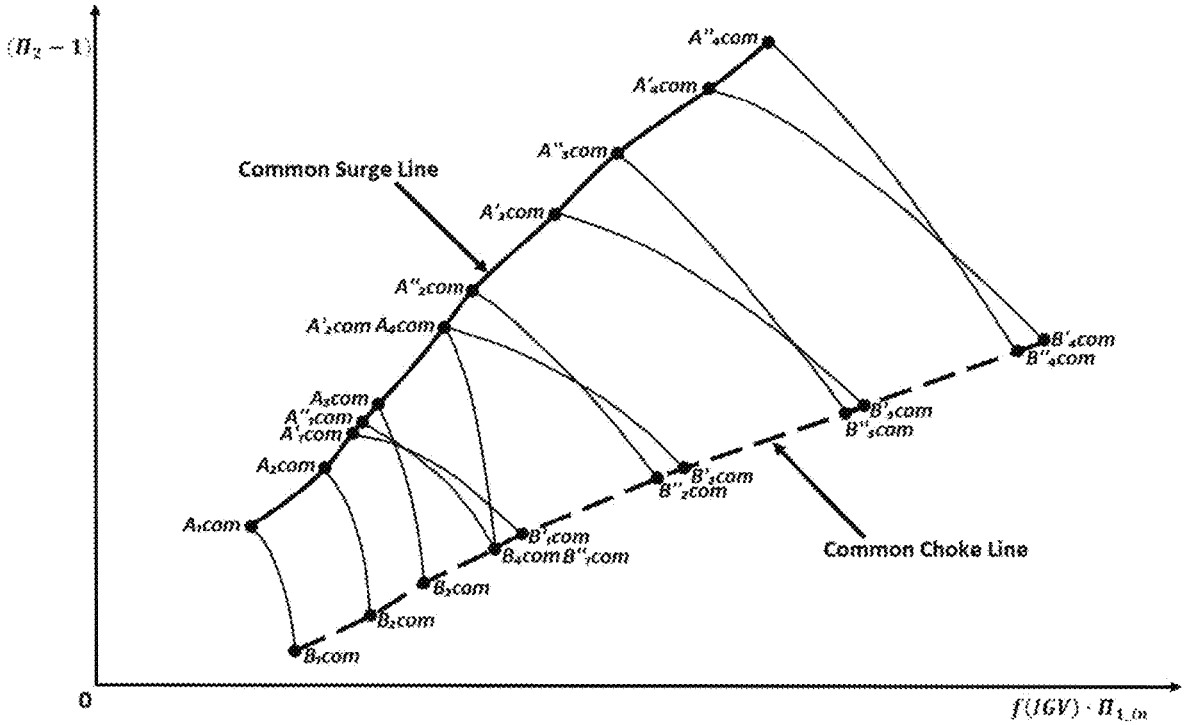
FIG. 10 reflects the effect of transforming the horizontal axis using the IGV function.

The result of applying the inlet guide vanes function to three sets of constant speed performance curves for three IGV opening positions in FIG. 8 is presented in FIG. 10, which shows one combined set of all constant speed performance curves in the $f(IGV)\cdot\Pi_{1_in}$ coordinate relative to the $(\Pi_2-1)$ coordinate. Where all surge points can be approximated by a single surge line, and also all choke points can be aligned to form a choke line.

The same method of converting constant speed performance curves from rectangular to polar coordinates can now be applied to compressors with IGVs, provided that the π-term coordinate $\Pi_{1_in}$ is replaced by the new coordinate $f(IGV)\cdot\Pi_{1_in}$. An equal distance statement stating that the distance from the zero point to the surge point A, and the distance from zero point to the choke point B for each performance curve in FIG. 10 is still required for coordinate conversion. To equalize the two unequal radial coordinates of the surge and choke points, it is also necessary to calculate the polar conversion factor P.

The distance from the zero point to each surge point A can then be calculated as:

$$r_{surge} = \sqrt{(\Pi_2 - 1)_A^2 + (P \cdot f(IGV) \cdot \Pi_{1_in})_A^2} \tag{33}$$

where $(\Pi_2-1)_A$ and $(f(IGV)\cdot\Pi_{1_in})_A$—coordinates of the surge points A.

The distance from the zero point to each choke point B can be calculated as:

$$r_{choke} = \sqrt{(\Pi_2 - 1)_B^2 + (P \cdot f(IGV) \cdot \Pi_{1_in})_B^2} \tag{34}$$

where $(\Pi_2-1)$, and $(f(IGV)\cdot\Pi_{1_in})_B$—coordinates of the choke points B.

From the two equations (33) and (34), by assigning $r_{surge}=r_{choke}$, the polar conversion factor P for each constant speed performance curve AB can be calculated as:

$$P = \sqrt{\frac{(\Pi_2 - 1)_A^2 - (\Pi_2 - 1)_B^2}{(f(IGV) \cdot \Pi_{1_in})_B^2 - (f(IGV) \cdot \Pi_{1_in})_A^2}} \tag{35}$$

After the polar conversion factors have been calculated for each curve, it is necessary to calculate the arithmetic means or average of the polar conversion factors, the sum of the polar conversion factors divided by the total number of curves in the sets (m+1):

$$P_{mean_aveage} = \frac{P_1 + P_2 + P_3 + \ldots + P_{m-1} + P_m + P_{m+1}}{m+1} \tag{36}$$

Figure 11:
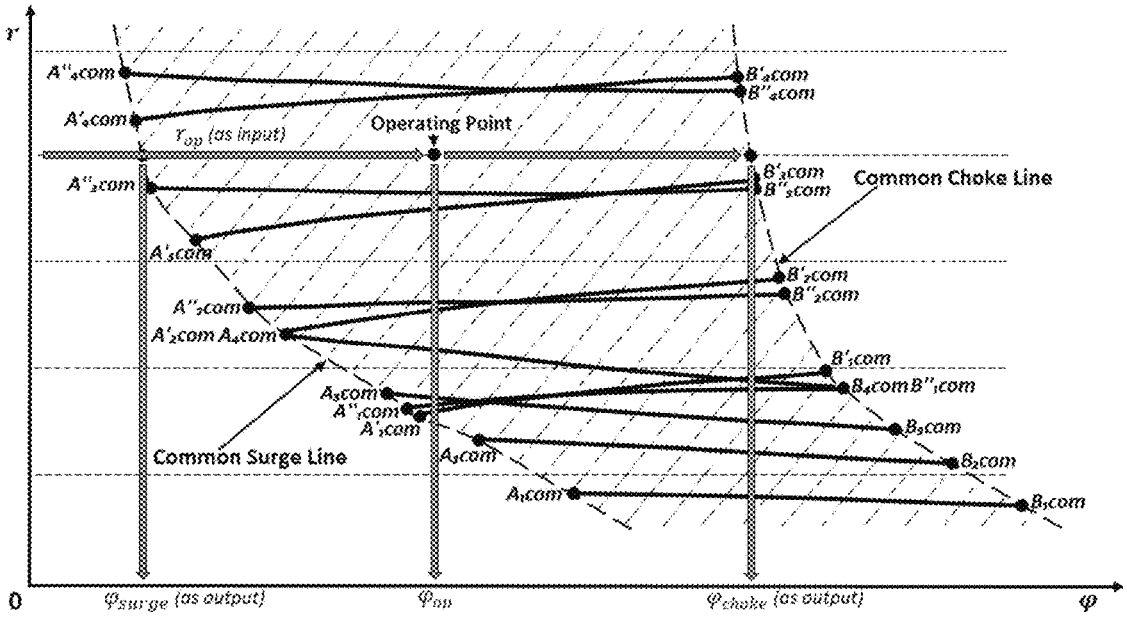
FIG. 11 depicts the effect of transformation by plotting polar coordinates r and φ on the rectangular coordinates for variable geometry compressors.

FIG. 11 illustrates the transformation effect, where the polar coordinates r and φ are plotted again in rectangular coordinates with straightened compressor performance curves, and the shaded area bounded by the surge and choke limiting lines defines the compressor operating area. The operating point in FIG. 11 is defined by the radial coordinate $r_{op}$ and the angular coordinate $\varphi_{op}$. As before in this invention, each point in the two-dimension polar coordinate system on the plane has a pair of polar coordinates (r, φ), but the equations for calculating the polar coordinates (r, φ) with respect to the IGV function are adjusted as shown below:

$$r = \sqrt{(\Pi_2 - 1)^2 + (P_{mean_aveage} \cdot f(IGV) \cdot \Pi_{1_in})^2} \tag{37}$$

$$\varphi = \text{ARCTAN}\left(\frac{P_{mean_aveage} \cdot f(IGV) \cdot \Pi_{1_in}}{(\Pi_2 - 1)}\right) \tag{38}$$

TABLE 1 can now be filled with surge and choke points taken from FIG. 11. After calculating the radial coordinate $r_{op}$ of the operating point, the angular coordinates $\varphi_{surge}$ and $\varphi_{choke}$ can be obtained from TABLE 1. This is graphically shown in FIG. 11 with the projections of the surge point $\varphi_{surge}$ and the choke point $\varphi_{choke}$ on the horizontal axis $\varphi$ and the calculated angular coordinates $\varphi_{op}$ of the operating point between them. The controlled variable CV (%) in percent can then be calculated for surge protection using equation (28), and for choke protection from equation (29).

Figure 12:
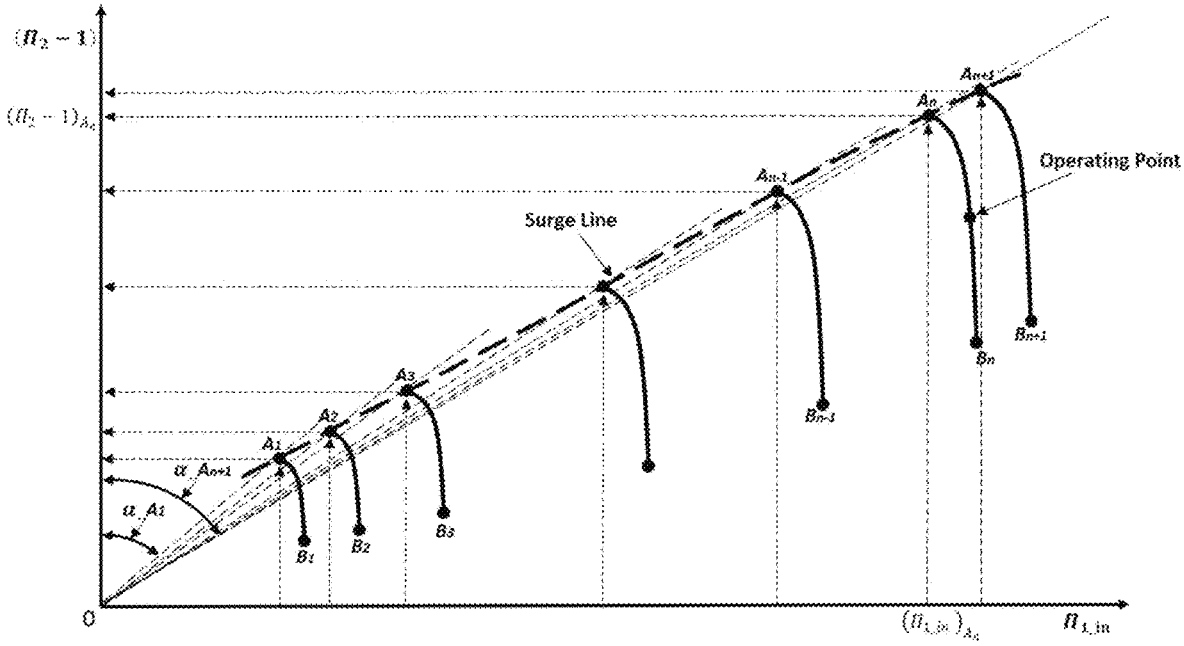
FIG. 12 shows a set of hypothetical constant speed performance curves with operating point, surge line, and maximum flow points with rays emanating from the pole indicating the polar coordinate α of the surge points.

A hypothetical compressor map is shown in FIG. 12 in $\pi$-term coordinates $\Pi_{1_in}$ and $(\Pi_2-1)$ without choke line, where A points are still the surge points and B points are the maximum flow endpoints on each performance curve. In this case, when the full range of compressor operation, defined from surge limit to choke limit, is not available, the controlled variable CV (%) can only be calculated for the surge protection.

Figure 13:
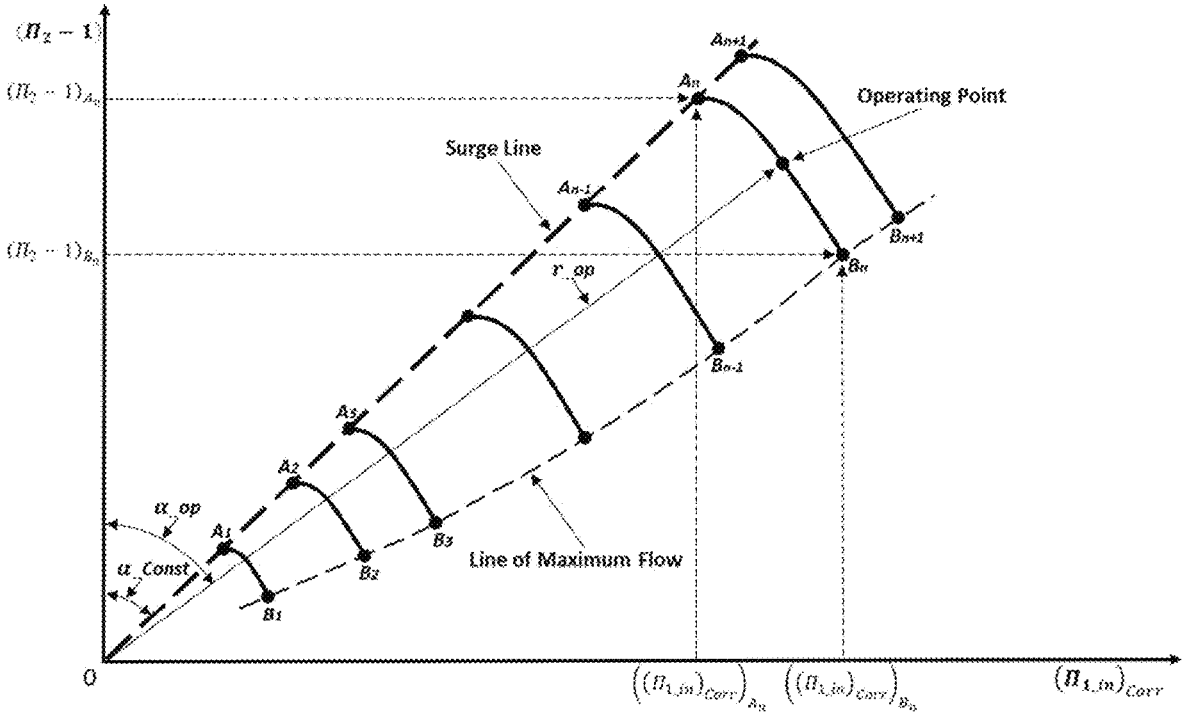
FIG. 13 represents the modified compressor map with a constant angular coordinate α.

The rays emanating from the zero point in FIG. 12 indicate the angular coordinates of all surge points from the polar angle $\alpha_A_1$ of the first surge point $A_1$ to the polar angle $\alpha_A_{n+1}$ of the last surge point $A_{n+1}$. Then FIG. 13 shows modified compressor map, where each surge point on the surge line now has the same angular coordinate. This is achieved by replacing the $\pi$-term Mach number coordinate $\Pi_{1_in}$ with the coordinate $(\Pi_{1_in})_{Corr}$, which is the corrected Mach number as a function of the $\pi$-term $(\Pi_2-1)$ obtained from surge points by the formula:

$$(\Pi_{1_in})_A = (\Pi_2 - 1)_A \tag{39}$$

The function shown below in tabular form in TABLE 3 with two columns of characteristic data, where $(\Pi_{1_in})_A$ is the argument and $(\Pi_2-1)_A$ is the function derived from FIG. 13 for surge points.

TABLE 3

| | | $\pi$-term Mach number | $(\Pi_2 - 1)$ as function |
|---|---|---|---|
| INPUT $(\Pi_{1_in})$ → | 1 | $(\Pi_{1_in})_{A_1}$ | $(\Pi_2 - 1)_{A_1}$ |
| | 2 | $(\Pi_{1_in})_{A_2}$ | $(\Pi_2 - 1)_{A_2}$ |
| | 3 | $(\Pi_{1_in})_{A_3}$ | $(\Pi_2 - 1)_{A_3}$ |
| | n − 1 | $(\Pi_{1_in})_{A_{n-1}}$ | $(\Pi_2 - 1)_{A_{n-1}}$ |
| | n | $(\Pi_{1_in})_{A_n}$ | $(\Pi_2 - 1)_{A_n}$ |
| | n + 1 | $(\Pi_{1_in})_{A_{n+1}}$ | $(\Pi_2 - 1)_{A_{n+1}}$ ↓ |
| | | | OUTPUT $(\Pi_{1_in})_{Corr}$ |

The same technique of converting constant speed performance curves from rectangular to polar coordinates can now be applied to compressors with only the surge limit line, provided that the $\pi$-term coordinate $\Pi_{1_in}$ is replaced by the new coordinate $(\Pi_{1_in})_{Corr}$.

To equalize the two unequal radial coordinates of the surge and maximum flow endpoint, it is also necessary to calculate the polar conversion factor P.

The distance from the zero point to each surge point A can then be calculated as:

$$r_{surge} = \sqrt{\left(\prod_2 - 1\right)_A^2 + \left(P \cdot \left(\prod_{1_in}\right)_{Corr}\right)_A^2} \tag{40}$$

where $(\Pi_2-1)_A$ and $((\Pi_{1_in})_A$—coordinates of the surge points A.

The distance from the zero point to each maximum flow endpoint B can be calculated as:

$$r_{max_flow} = \sqrt{\left(\prod_2 - 1\right)_B^2 + \left(P \cdot \left(\prod_{1_in}\right)_{Corr}\right)_B^2} \tag{41}$$

where $(\Pi_2-1)_B$ and $((\Pi_{1_in})_{Corr})_B$—coordinates of the maximum flow points B.

From the two equations (40) and (41), setting that $r_{surge}=r_{max_flow}$, the polar conversion factor P for each AB constant speed performance curve can be calculated as:

$$P = \sqrt{\frac{\left(\prod_2 - 1\right)_A^2 - \left(\prod_2 - 1\right)_B^2}{\left(\left(\prod_{1_in}\right)_{Corr}\right)_B^2 + \left(\left(\prod_{1_in}\right)_{Corr}\right)_A^2}} \tag{42}$$

The arithmetic means or average of the polar conversion factors, the sum of the polar conversion factors divided by the total number of curves can be calculated using the equation (25).

Figure 14:
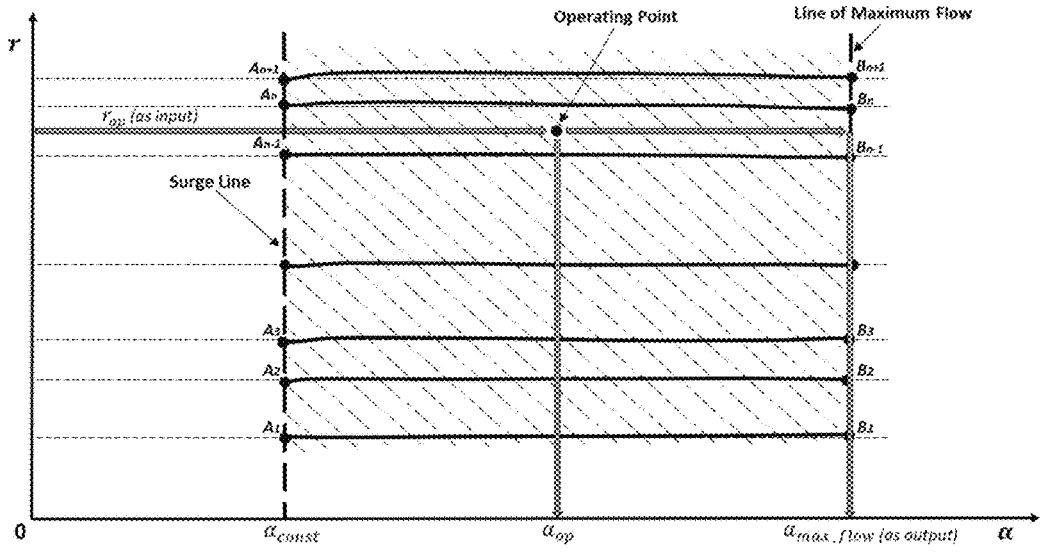
FIG. 14 depicts the effect of transforming by plotting polar coordinates r and α on rectangular coordinates with only surge limit available.

FIG. 14 illustrates the effect of polar transformation by displaying a radial coordinate r and an angular coordinate $\alpha$ in rectangular coordinates. FIG. 14 shows the straitened performance curves and the shaded area bounded by a surge line on one side, defined as a vertical line with a constant angular coordinate, and a line, connecting the endpoints on the other side.

The equations for calculating of a pair of polar coordinates (r, $\alpha$) are shown below:

$$r = \sqrt{\left(\prod_2 - 1\right)^2 + \left(P_{mean_average} \cdot \left(\prod_{1_in}\right)_{Corr}\right)^2} \tag{43}$$

$$\alpha = \text{ARCTAN}\left(\frac{P_{mean_average} \cdot \left(\prod_{1_in}\right)_{Corr}}{\left(\prod_2 - 1\right)}\right) \tag{44}$$

TABLE 4 is populated with surge points and maximum flow endpoints taken from FIG. 14, where the surge points polar angle column is constant. After calculating the radial coordinate $r_{op}$ of the operating point, the angular coordinates $\alpha_{const}$ and $\alpha_{max_flow}$ are obtained from TABLE 4.

TABLE 4

| | | Radial coordinate | Polar angle of surge point | Polar angle of choke point |
|---|---|---|---|---|
| INPUT $(r_{op})$ → | 1 | $(r)_1$ | $\alpha_{const}$ | $(\alpha_{max_flow})_1$ |
| | 2 | $(r)_2$ | $\alpha_{const}$ | $(\alpha_{max_flow})_2$ |
| | 3 | $(r)_3$ | $\alpha_{const}$ | $(\alpha_{max_flow})_3$ |
| | n − 1 | $(r)_{n-1}$ | $\alpha_{const}$ | $(\alpha_{max_flow})_{n-1}$ |
| | n | $(r)_n$ | $\alpha_{const}$ | $(\alpha_{max_flow})_n$ |
| | n + 1 | $(r)_{n+1}$ | $\alpha_{const}$ ↓ | $(\alpha_{max_flow})_{n+1}$ ↓ |
| | | | OUT1 $(\alpha_{const})$ | OUT2 $(\alpha_{max_flow})$ |

Graphically it is shown in FIG. 14 with the constant coordinate of the surge points (angular coordinate $\alpha_{const}$) and the projection of the maximum flow endpoint (angular coordinates $\alpha_{max_flow}$) onto the horizontal a axis with the calculated operating point (angular coordinates $\alpha_{op}$) between them.

The controlled variable CV (%) in percent for the surge protection controller in the case of maximum flow endpoints can be calculated relative to the surge limit as the polar angle of the operating point $\alpha_{op}$ minus the constant $\alpha_{const}$ (polar angle of the surge points) divided by the specified operating range up to maximum flow line, defined as subtracting the constant from the polar angle of the maximum flow endpoint $\alpha_{max_flow}$:

$$CV(\%) = 100\% \cdot \frac{\alpha_{op} - \alpha_{const}}{\alpha_{max_flow} - \alpha_{const}}\Bigg|_{r_{op}} \tag{45}$$

It can be assumed that the hypothetical compressor map, shown in FIG. 12 in π-term coordinates $\Pi_{1_in}$ and $(\Pi_2-1)$ has only surge points A obtained during commissioning. The rays emanating from the zero point in FIG. 12 still indicate the angular coordinates of all surge points, from the polar angle $\alpha_A_1$ of the surge point $A_1$ to the polar angle $\alpha_A_{n+1}$ of the surge point $A_{n+1}$. Similarly, the surge line and surge points may be presented in a corrected Mach number coordinate $(\Pi_{1_in})_{Corr}$ as the function of π-term coordinates $(\Pi_2-1)$ in FIG. 13, where each surge point on the surge line has the same polar angle. The corrected Mach number coordinate $(\Pi_{1_in})_{Corr}$ still can be found from the equation (38), and TABLE 3 with two columns of characteristic data obtained from surge points is still applicable when only surge points are available. In the absence of performance curves, the calculation of the polar conversion factor P would be impossible. A pair of polar coordinates (r, α) can be calculated from equation (43) and (44) with the parameter $P_{mean_average}$ equal to one:

$$r = \sqrt{\left(\prod_2 - 1\right)^2 + \left(\left(\prod_{1_in}\right)_{Corr}\right)^2} \tag{46}$$

$$\alpha = \text{ARCTAN}\left(\frac{\left(\prod_{1_in}\right)_{Corr}}{\left(\prod_2 - 1\right)}\right) \tag{47}$$

The controlled variable CV (%) in percent for the surge protection controller can be calculated as the polar angle of the operating point $\alpha_{op}$ minus constant $\alpha_{const}$ the polar angle of the surge points, divided by the polar angle of the surge points:

$$CV(\%) = 100\% \cdot \frac{\alpha_{op} - \alpha_{const}}{\alpha_{const}} \tag{48}$$

Figure 15:
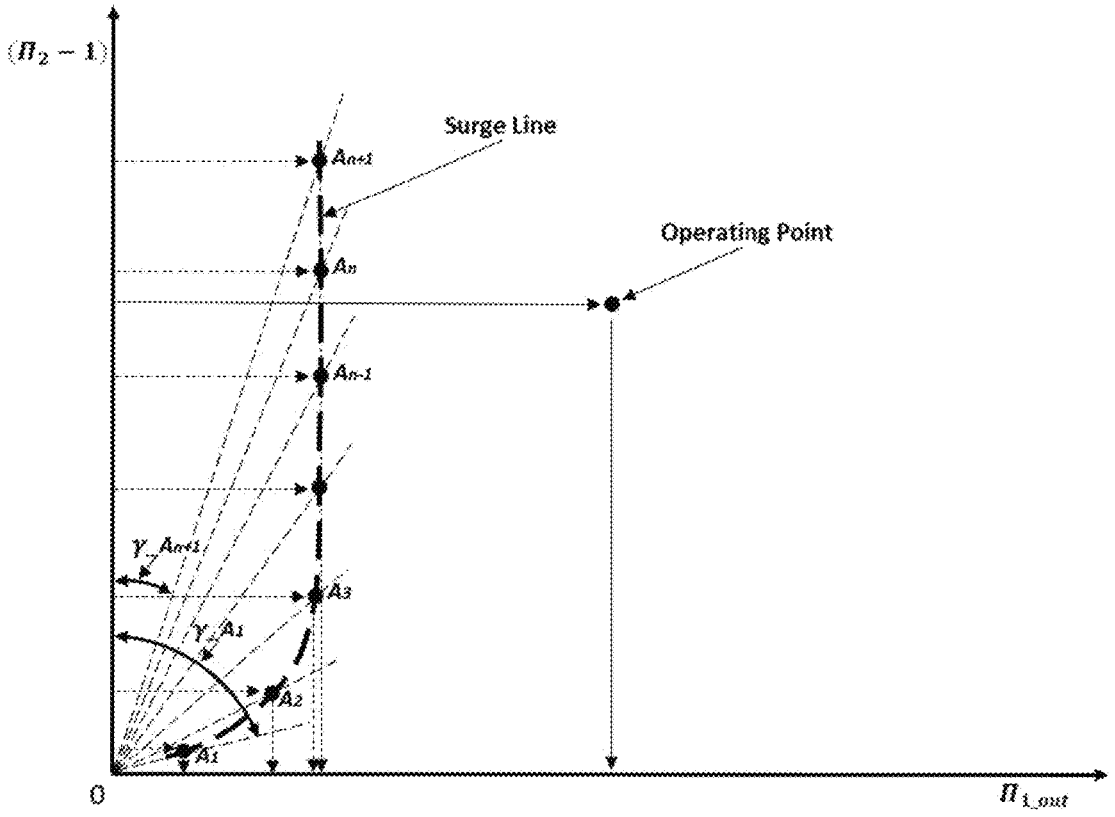
FIG. 15 shows the most common surge line shape in rectangular coordinates when the horizontal axis is the π-term Mach number at outlet of the compressor.

If surge points are collected during commissioning with a flow meter located downstream of the compressor, the π-term Mach number is calculated as the Mach number at the outlet of the compressor. FIG. 15 shows surge line and surge points A in the π-term coordinates $\Pi_{1_out}$ and $(\Pi_2-1)$, as they are obtained from field tests without performance curves. Very often, for a Mach number calculated at the outlet of the compressor, starting from a nominal compression ratio of about 4.0 to 5.0 and above, the surge line can become vertical. In this case, there are two ways to calculate the percentage controlled variable CV (%). The first uses equation (19), which links the Mach numbers at the compressor inlet and outlet by changing $\Pi_{1_out}$ to $\Pi_{1_in}$.

The second uses the π-term coordinate $\Pi_{1_out}$, but the π-term coordinate $(\Pi_2-1)$ is replaced with a new corrected coordinate so that each surge point has the same polar angle. This is achieved by replacing the π-term coordinate $(\Pi_2-1)$ with the coordinate $(\Pi_2-1)_{Corr}$, which is a function of the π-term Mach number $\Pi_{1_out}$ obtained from surge points by the formula:

$$(\Pi_2-1)_A = (\Pi_{1_out})_A \tag{49}$$

Figure 16:
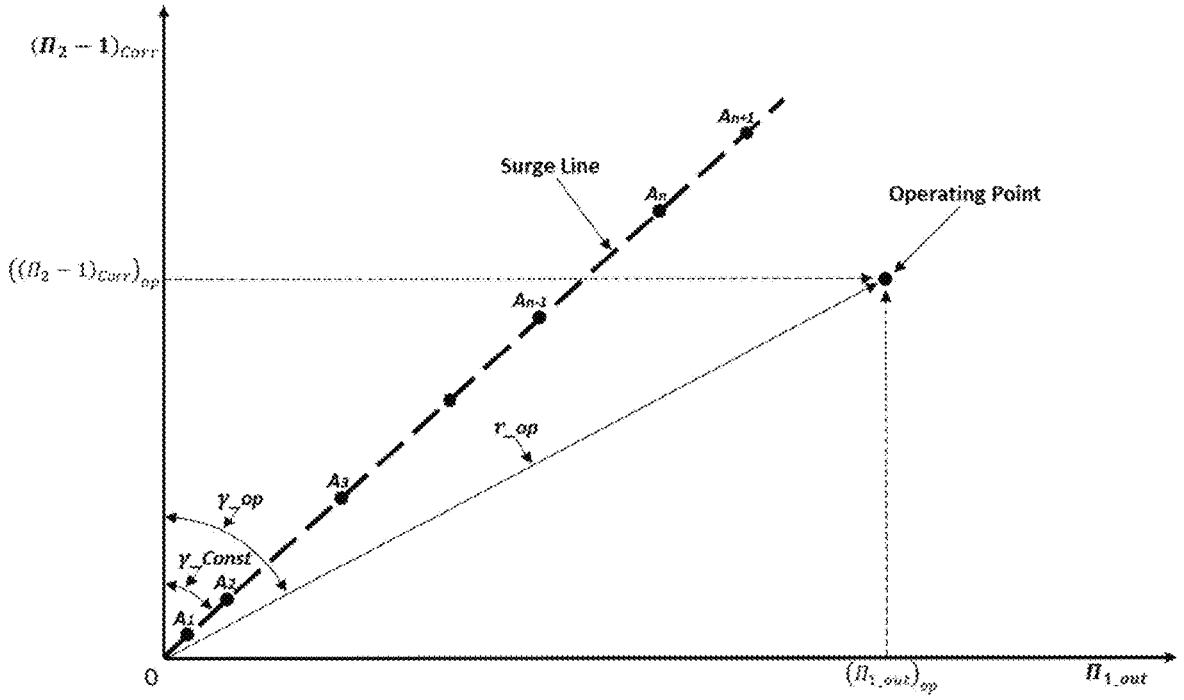
FIG. 16 depicts a modified surge line in polar coordinates with a constant angular coordinate γ.

FIG. 15 shows a surge line with angular coordinates of all surge points from the polar angle $\gamma_A_1$ of the first surge point $A_1$ to the polar angle $\gamma_A_{n+1}$ of the last surge point $A_{n+1}$. FIG. 16 shows the modified surge line in rectangular coordinates, but with surge points having the same polar angle or the polar coordinate $\gamma_{const}$. The function shown below in tabular form in TABLE 5 with two columns of characteristic data, where the coordinate $(\Pi_2-1)_A$ is the argument and $(\Pi_{1_out})_A$ is the function, are obtained from surge points in FIG. 15.

In the absence of compressor characteristic curves, the polar radius r can be calculated from the equation below:

$$r = \sqrt{\left(\left(\prod_2 - 1\right)_{Corr}\right)^2 + \left(\prod_{1_out}\right)^2} \tag{50}$$

and the angular coordinate γ can be calculated using the equation:

$$\gamma = \text{ARCTAN}\left(\frac{\prod_{1_out}}{\left(\prod_2 - 1\right)_{Corr}}\right) \tag{51}$$

The controlled variable CV (%) in percent for the surge protection controller can be calculated as the polar angle of the operating point $\gamma_{op}$ minus constant $\gamma_{const}$ the polar angle of the surge points, divided by the polar angle of the surge points:

$$CV(\%) = 100\% \cdot \frac{\gamma_{op} - \gamma_{const}}{\gamma_{const}} \tag{52}$$

TABLE 5

| | | π-term $(\Pi_2 - 1)$ | $(\Pi_{1_out})$ as function |
|---|---|---|---|
| INPUT $(\Pi_2 - 1)$ → | 1 | $(\Pi_2 - 1)_{A_1}$ | $(\Pi_{1_out})_{A_1}$ |
| | 2 | $(\Pi_2 - 1)_{A_2}$ | $(\Pi_{1_out})_{A_2}$ |
| | 3 | $(\Pi_2 - 1)_{A_3}$ | $(\Pi_{1_out})_{A_3}$ |
| | n − 1 | $(\Pi_2 - 1)_{A_{n-1}}$ | $(\Pi_{1_out})_{A_{n-1}}$ |
| | n | $(\Pi_2 - 1)_{A_n}$ | $(\Pi_{1_out})_{A_n}$ |
| | n + 1 | $(\Pi_2 - 1)_{A_{n+1}}$ | $(\Pi_{1_out})_{A_{n+1}}$ ↓ OUTPUT $((\Pi_2 - 1)_{Corr})$ |

Figure 17:
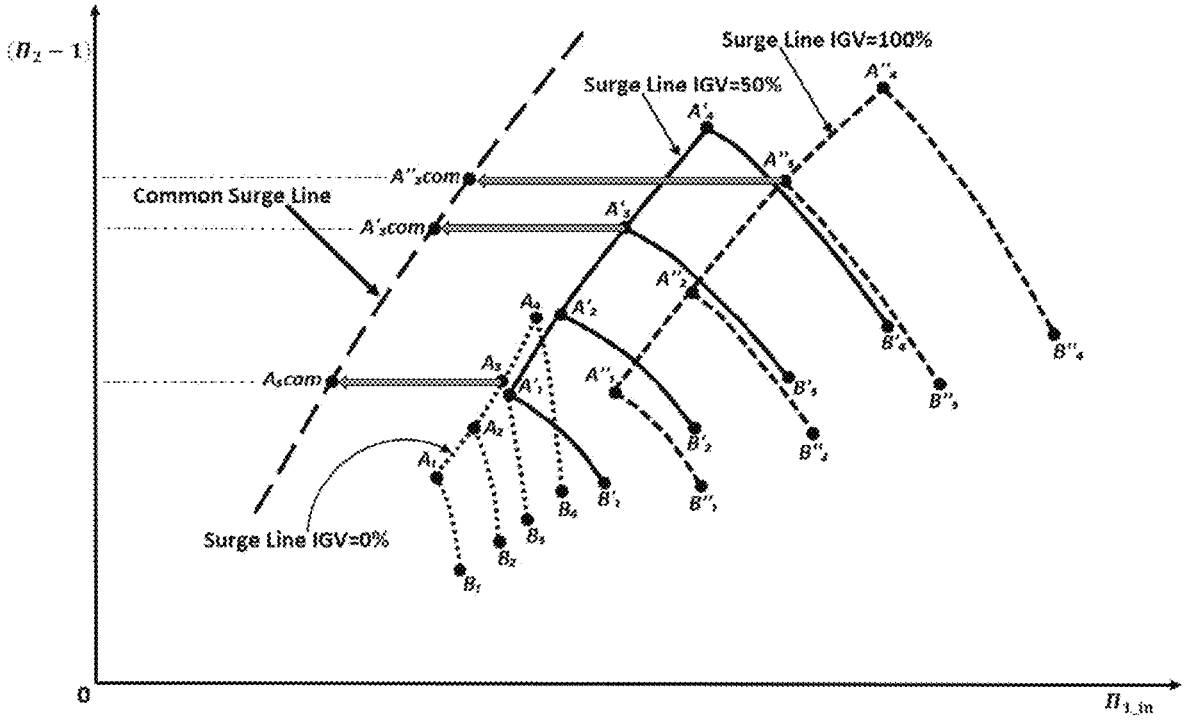
FIG. 17 shows a set of hypothetical performance curves for a constant speed, variable geometry compressor with surge line and maximum flow endpoints.

The effect of the IGV opening on compressor performance is shown in FIG. 17, similar to that shown in FIG. 8, with the difference that B points represent the endpoints of the maximum flow. Therefore, FIG. 17 represents a case where a hypothetical compressor map is shown in π-term coordinates $\Pi_{1_in}$ and $(\Pi_2-1)$ with surge line but no choke line; with three sets of constant speed performance curves representing three IGV opening positions of 0%, 50% and 100%, and each of them consists of four curves. Likewise, lines $A_1B_1$, $A_2B_2$, $A_3B_3$ and $A_4B_4$, refer to constant speed performance curves at 0% IGV position; lines $A'_1B'_1$, $A_2'B'_2$, $A'_3B'_3$ and $A'_4B'_4$ to constant speed performance curves at 50% IGV; and lines $A''_1B''_1$, $A''_2B''_2$, $A''_3B''_3$ and $A''_4B''_4$ for constant speed performance curves at 100% IGV. Since the surge points are identical to those shown in FIG. 8, and do not change their positions, the IGV function shown in TABLE 2 can be used.

Figure 18:
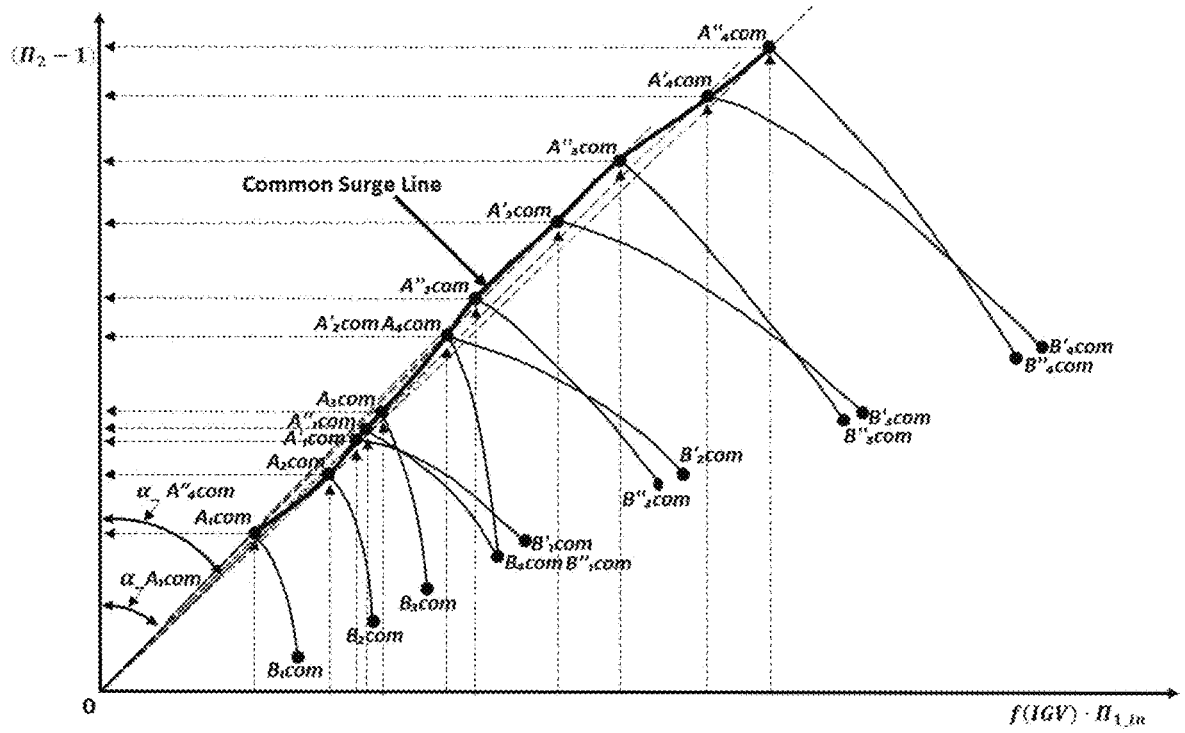
FIG. 18 shows the effect of transforming the horizontal axis using the IGV function and the rays emanating from the pole, indicating the polar coordinate α of the surge points.

FIG. 18 shows the result of applying the inlet guide vanes function to three sets of constant speed performance curves with one common surge line in coordinates $f(\mathrm{IGV})\cdot\Pi_{1_in}$ and $(\Pi_2-1)$.

Again, in the absence of a choke line, the control variable CV (%) can only be calculated for surge protection. The rays emanating from the zero point in FIG. 18 indicate the angular coordinates of all surge points from the polar angle $\alpha_A_1$com of the surge point $A_1$com to the polar angle $\alpha_A''_4$com of the surge point $A''_4$com.

Figure 19:
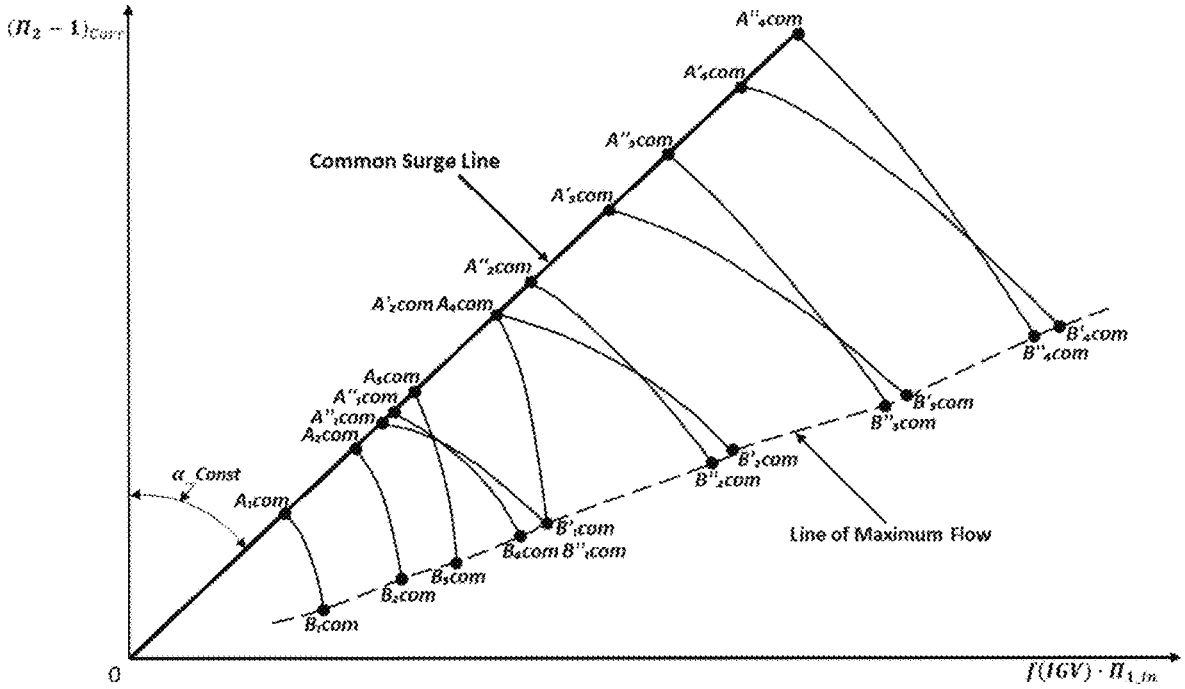
FIG. 19 shows a modified surge line with constant polar coordinate α for variable geometry compressors.

FIG. 19 shows a modified compressor map, which is a modification of the compressor map shown in FIG. 18, where the π-term coordinate $(\Pi_2-1)$ is replaced with a new corrected coordinate such that each surge point has the same polar angular. This is achieved in the same way as before, replacing the π-term coordinate $(\Pi_2-1)$ with the coordinate $(\Pi_2-1)_{Corr}$, but as a function of the π-term Mach number $f(\mathrm{IGV})\cdot\Pi_{1_in}$ of the surge points shown in FIG. 18. The corrected coordinate $(\Pi_2-1)_{Corr}$ is calculated for each surge point using the formula:

$$(\Pi 2-1)_A=(f(\mathrm{IGV})\cdot\Pi_{1_in})_A \tag{53}$$

The same method of converting constant speed performance curves from rectangular to polar coordinates can now be applied to compressors with the IGV and the endpoints of the maximum flow. An equal distance statement for each performance curve that declares the distance from the zero point to the surge point A and from the zero point to the maximum flow endpoint B, as well as the calculation of the polar conversion factor P, are still required for polar conversion.

The distance from the zero point to each surge point A can then be calculated as:

$$r_{surge}=\sqrt{\left(\left(\prod_2-1\right)_{Corr}\right)_A^2+\left(P\cdot f(IGV)\cdot\prod_{1_in}\right)_A^2} \tag{54}$$

where $((\Pi_2-1)_{Corr})_A$ and $(f(\mathrm{IGV})\cdot\Pi_{1_in})_A$—coordinates of the surge points A.

The distance from the zero point to each maximum flow endpoint B can be calculated as:

$$r_{max_flow}=\sqrt{\left(\left(\prod_2-1\right)_{Corr}\right)_B^2+\left(P\cdot f(IGV)\cdot\prod_{1_in}\right)_B^2} \tag{55}$$

where $((\Pi_2-1)_{Corr})_B$ and $(f(\mathrm{IGV})\cdot\Pi_{1_in})_A$—coordinates of the maximum flow points B.

From the two equations (54) and (55), setting $r_{surge}=r_{max_flow}$, the polar conversion factor P for each AB constant speed performance curve can be calculated as:

$$P=\sqrt{\frac{\left(\left(\prod_2-1\right)_{Corr}\right)_A^2-\left(\left(\prod_2-1\right)_{Corr}\right)_B^2}{\left(f(IGV)\cdot\prod_{1_in}\right)_B^2-\left(f(IGV)\cdot\prod_{1_in}\right)_A^2}} \tag{56}$$

The arithmetic mean $P_{mean_average}$ can be calculated from the formula (36) as the sum of the polar conversion factors divided by the total number of curves in the sets. As before, in a two-dimension polar coordinate system on the plane, each point corresponds to a pair of polar coordinates (r, α), but equations for calculating the polar coordinates (r, α) must be adjusted as shown below:

$$r=\sqrt{\left(\left(\prod_2-1\right)_{Corr}\right)^2+\left(P_{mean_average}\cdot f(IGV)\cdot\prod_{1_in}\right)^2} \tag{57}$$

$$\alpha=\mathrm{ARCTAN}\left(\frac{P_{mean_average}\cdot f(IGV)\cdot\prod_{1_in}}{\left(\prod_2-1\right)_{Corr}}\right) \tag{58}$$

Figure 20:
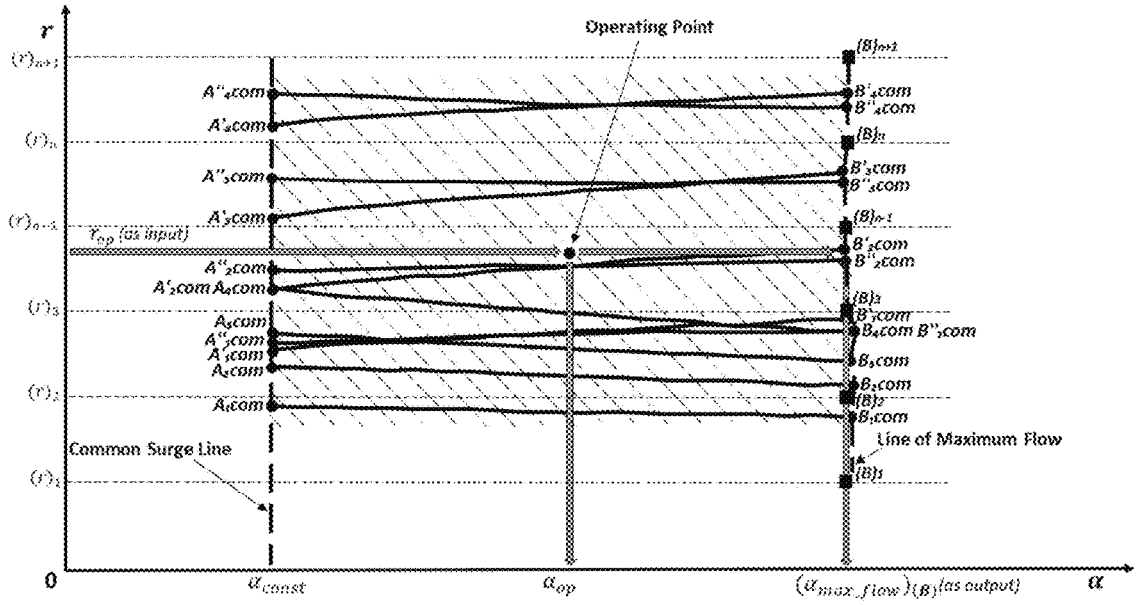
FIG. 20 depicts the effect of transformation by plotting polar coordinates r and α on rectangular coordinates for variable geometry compressors for which only surge limit is available.

FIG. 20 illustrates a polar transformation, where the polar coordinates r and α are plotted in rectangular coordinates, the performance curves are flattened, and the shaded area surrounded by the surge limiting line and the maximum flow line, defines the compressor operating area.

TABLE 6 is populated with surge points and maximum flow endpoints taken from FIG. 20, where the polar angle of the surge points is constant, and the polar angles of the maximum flow endpoints marked with a symbol (■) are defined as the points of intersection of the r coordinates with the maximum flow line at points $(B)_1$, $(B)_2$, $(B)_3$ . . . $(B)_{n-1}$, $(B)_n$ and $(B)_{n+1}$.

The radial coordinates $r_{op}$ and $\alpha_{op}$ of the operating point can be calculated from equations (57) and (58). The angular coordinates $\alpha_{const}$ and $\alpha_{max_flow}$ are obtained from TABLE 6.

TABLE 6

| | | Radial coordinate | Polar angle of surge point | Polar angle of choke point |
|---|---|---|---|---|
| | 1 | $(r)_1$ | $\alpha_{const}$ | $(\alpha_{max_flow})_{(B)1}$ |
| | 2 | $(r)_2$ | $\alpha_{const}$ | $(\alpha_{max_flow})_{(B)2}$ |
| INPUT ($r_{op}$) → | 3 | $(r)_3$ | $\alpha_{const}$ | $(\alpha_{max_flow})_{(B)3}$ |
| | n − 1 | $(r)_{n-1}$ | $\alpha_{const}$ | $(\alpha_{max_flow})_{(B)n-1}$ |
| | n | $(r)_n$ | $\alpha_{const}$ | $(\alpha_{max_flow})_{(B)n}$ |
| | n + 1 | $(r)_{n+1}$ | $\alpha_{const}$ | $(\alpha_{max_flow})_{(B)n+1}$ |
| | | | ↓ | ↓ |
| | | | OUT1 ($\alpha_{const}$) | OUT2 ($\alpha_{max_flow}$) |

Graphically it is shown in FIG. 20 with the constant surge point coordinate (angular coordinates $\alpha_{const}$) and the projection of the maximum flow endpoint (angular coordinates $\alpha_{max_flow}$) onto the horizontal axis a with the calculated operating point (angular coordinates $\alpha_{op}$) between them. The controlled variable CV (%) in percent for the surge protection controller in the case of a variable geometry compressor with surge line and maximum flow endpoints can be calculated relative to the surge limit from equation (45).

It can now be assumed that only surge points A in FIG. 17 are known. In the same way, the displacement of the surge points $A_3$, $A'_3$ and $A''_3$ to the left with unchanged $(\Pi_2-1)$ coordinates denote the new positions of the surge points $A_3$com, $A'_3$com and $A''_3$com on the line defined as the expected common surge line. The IGV function can still be calculated by dividing the coordinates of the surge points $A_3$com, $A'_3$com and $A''_3$com by the coordinates of the surge points $A_3$, $A'_3$ and $A''_3$, respectively. And TABLE 2 again can be populated with characteristic data representing the IGV position from 0% to 100%, and a function $f$(IGV) obtained for all available surge points by forming the expected common surge line.

In absence of the performance curves the rays emanating from the zero point in FIG. 18 still indicate the angular coordinates of all surge points from the polar angle $\alpha_A_1$com of the surge point $A_1$com to the polar angle $\alpha_A''_4$com of the surge point $A''_4$com. Surge points A still have the equal polar angle in the $\pi$-term coordinates $f(IGV)\cdot\Pi_{1_in}$ and $(\Pi_2-1)_{Corr}$ in FIG. 19. In the case when only surge points are present, the polar radius r can be calculated from equation (57) and the angular coordinate $\alpha$ can be calculated from equation (58), where the parameter $P_{mean_average}$ is equal to one:

$$r=\sqrt{\left(\left(\prod_2-1\right)_{Corr}\right)^2+\left(f(IGV)\cdot\prod_{1_in}\right)^2} \tag{59}$$

$$\alpha=\mathrm{ARCTAN}\left(\frac{f(IGV)\cdot\prod_{1_in}}{\left(\prod_2-1\right)_{Corr}}\right) \tag{60}$$

And then the controlled variable CV (%) in percent for the surge protection controller can be calculated from equation (48).

I claim:

1. A method for controlling the operation of a centrifugal or axial compressor equipped with automatic control systems that continuously calculate system parameters, said method comprising:

reading one or more input signals from one or more sensors;

converting a compressor performance map comprising at least one compressor performance curve and a first boundary condition comprising one or more first boundary points into rectangular coordinates of flow Mach number and total pressure ratio;

selecting one or more of said first boundary points of said first boundary condition;

calculating a polar conversion factor for each of said one or more first boundary points along said first boundary condition;

converting said compressor performance map from rectangular coordinates to polar coordinates;

measuring an operating point of the centrifugal or axial compressor via said input signals from said one or more sensors;

calculating a control variable in polar coordinates;

calculating an error value from a difference between a set point and said control variable in polar coordinates; and sending a control signal to a compressor control mechanism such that said control variable is moved closer to said set point to reduce said error value.

2. The method of claim 1, wherein said compressor control mechanism comprises a mechanism selected from the group consisting of an anti-surge valve and an outlet valve.

3. The method of claim 1, further comprising:

a second boundary condition comprising one or more second boundary points on said compressor performance map;

converting said one or more second boundary points of said second boundary condition into rectangular coordinates of flow Mach number and total pressure ratio;

selecting one or more of said one or more second boundary points of said second boundary condition;

calculating a second polar conversion factor for each of said selected one or more second boundary points of said second boundary condition; and calculating an average polar conversion factor from said polar conversion factor and said second polar conversion factor for each of said one or more first boundary points along said first boundary condition and said one or more second boundary points along said second boundary condition.

4. The method of claim 3, wherein said first boundary condition comprises one or more surge points and said second boundary condition comprises one or more choke points.

5. The method of claim 4, further comprising:

selecting one or more surge point polar radii from said one or more surge points;

selecting one or more choke point polar radii from said one or more choke points;

defining one or more performance curves between said one or more surge point polar radii and said one or more choke point polar radii; and setting said average polar conversion factor based on aligning said one or more surge point polar radii with said one or more choke point polar radii for said one or more performance curves.

6. The method of claim 3, wherein said first boundary condition comprises one or more surge points and said second boundary condition comprises one or more max flow points.

7. The method of claim 6, further comprising:

selecting one or more surge point polar radii from said one or more surge points;

selecting one or more max flow point polar radii from said one or more max flow points;

defining one or more performance curves between said one or more surge point polar radii and said one or more max flow point polar radii; and setting said average polar conversion factor based on aligning said one or more surge point polar radii with said one or more max flow point polar radii for said one or more performance curves.

8. The method of claim 1, wherein said Mach number for the centrifugal or axial compressor is determined from a total mass flow entering the centrifugal or axial compressor from an upstream compressor and a side stream mass flow.

9. A method for controlling the operation of a centrifugal or axial compressor equipped with variable inlet guide vanes or variable stator vanes and automatic control systems that continuously calculate system parameters, said method comprising:

reading one or more input signals from one or more sensors;

converting a compressor performance map comprising a plurality of compressor performance curves defined by the variable inlet guide vane position or the variable stator vane position and a plurality of first boundary conditions comprising one or more first boundary points, said plurality of first boundary conditions defined by the variable inlet guide position or the variable stator vane position, into rectangular coordinates of flow Mach number and total pressure ratio;

selecting a design operating speed of the centrifugal or axial compressor;

selecting a plurality of first original speed boundary points corresponding to said design operating speed of the centrifugal or axial compressor from each of said plurality of first boundary conditions;

shifting each of said plurality of first original speed boundary points to lower Mach numbers at constant pressure ratio to define a plurality of first modified speed boundary points;

calculating a first IGV function from the ratio of the Mach number of said plurality of first modified speed boundary points to the Mach number of said plurality of first original speed boundary points;

applying said first IGV function to each of said plurality of first boundary conditions to define a first common boundary condition with a plurality of first common boundary points;

calculating a first polar conversion factor for each of said plurality of common boundary points along said first common boundary condition;

converting said compressor performance map from rectangular coordinates to polar coordinates;

measuring an operating point of the centrifugal or axial compressor via said input signals from said one or more sensors;

calculating a control variable in polar coordinates;

calculating an error value from a difference between a set point and said control variable in polar coordinates; and sending a control signal to a compressor control mechanism such that said control variable is moved closer to said set point to reduce said error value.

10. The method of claim 9, wherein said compressor control mechanism comprises a mechanism selected from the group consisting of an anti-surge valve, an outlet valve, a variable inlet guide vane controller, and a variable stator vane controller.

11. The method of claim 9, further comprising:

a plurality of second boundary conditions comprising one or more second boundary points on said compressor performance map, said plurality of second boundary conditions defined by the variable inlet guide position or the variable stator vane position;

converting said one or more second boundary points of said plurality second boundary conditions into rectangular coordinates of flow Mach number and total pressure ratio;

selecting a plurality of second original speed boundary points corresponding to said design operating speed of the centrifugal or axial compressor from each of said plurality of second boundary conditions;

shifting each of said plurality of second original speed boundary points to lower Mach numbers at constant pressure ratio to define a plurality of second modified speed boundary points;

calculating a second IGV function from the ratio of the Mach number of said plurality of second modified speed boundary points to the Mach number of said plurality of second original speed boundary points;

applying said second IGV function to each of said plurality of second boundary conditions to define a second common boundary condition with a plurality of second common boundary points;

calculating a second polar conversion factor for each of said plurality of second common boundary points along said second common boundary condition; and calculating an average polar conversion factor from said first polar conversion factor and said second polar conversion factor for each of said plurality of first common boundary points along said first common boundary condition and said second common boundary points along said second common boundary to define said first common boundary condition in polar coordinates at a constant angle and said second common boundary condition in polar coordinates at a constant angle.

12. The method of claim 11, wherein said first boundary condition comprises one or more surge points and said second boundary condition comprises one or more choke points.

13. The method of claim 12, further comprising:

selecting one or more surge point polar radii from said one or more surge points;

selecting one or more choke point polar radii from said one or more choke points;

defining one or more performance curves between said one or more surge point polar radii and said one or more choke point polar radii; and setting said average polar conversion factor based on aligning said one or more surge point polar radii with said one or more choke point polar radii for said one or more performance curves.

14. The method of claim 13, wherein said first boundary condition comprises one or more surge points and said second boundary condition comprises one or more max flow points.

15. The method of claim 14, further comprising:

selecting one or more surge point polar radii from said one or more surge points;

selecting one or more max flow point polar radii from said one or more max flow points;

defining one or more performance curves between said one or more surge point polar radii and said one or more max flow point polar radii; and setting said average polar conversion factor based on aligning said one or more surge point polar radii with said one or more max flow point polar radii for said one or more performance curves.

16. The method of claim 9, wherein said Mach number for the centrifugal or axial compressor is determined from a total mass flow entering the centrifugal or axial compressor from an upstream compressor and a side stream mass flow.

17. A method for controlling the operation of at least two centrifugal or axial compressors operating in parallel or in series equipped with automatic control systems that continuously calculate system parameters, said method comprising:

reading one or more input signals from one or more sensors;

converting a first compressor performance map comprising at least one first compressor performance curve and a first boundary condition comprising one or more first boundary points into rectangular coordinates of flow Mach number and total pressure ratio;

converting a second compressor performance map comprising at least one second compressor performance curve and a second boundary condition comprising one or more second boundary points into rectangular coordinates of flow Mach number and total pressure ratio;

selecting one or more of said first boundary points of said first boundary condition;

calculating a first polar conversion factor for each of said one or more first boundary points along said first boundary condition;

converting said first compressor performance map from rectangular coordinates to polar coordinates;

calculating a first control variable in polar coordinates;

selecting one or more of said second boundary points of said second boundary condition;

calculating a second polar conversion factor for each of said one or more second boundary points along said second boundary condition;

converting said second compressor performance map from rectangular coordinates to polar coordinates;

calculating a second control variable in polar coordinates;

measuring a first operating point of one of the centrifugal or axial compressors and a second operating point of another of the centrifugal or axial compressors via said input signals from said one or more sensors;

calculating a first error value from a difference between a first set point and said first control variable in polar coordinates;

calculating a second error value from a difference between a second set point and a second control variable in polar coordinates;

wherein said first set point and said second set point are selected to distribute a load between one of the centrifugal or axial compressors and another of the centrifugal or axial compressors; and sending a control signal to one or more capacity control devices such that said load is distributed between one of the centrifugal or axial compressors and another of the centrifugal or axial compressors.

* * * * *